United States Patent [19]

Barriquand et al.

[11] Patent Number: 4,716,659

[45] Date of Patent: Jan. 5, 1988

[54] METHOD AND INSTALLATION FOR REMOVING WATER FROM, DRYING AND/OR CONDITIONING FIBROUS, POROUS OR FILAMENT MATERIALS

[75] Inventors: Bernard Barriquand; François Villard; Charles Deleage, all of Roanne, France

[73] Assignee: Barriquand, Roanne, France

[21] Appl. No.: 848,142

[22] Filed: Apr. 4, 1986

[30] Foreign Application Priority Data

Apr. 5, 1985 [FR] France ..... 85 05266

[51] Int. Cl.[4] ..... F26B 3/06

[52] U.S. Cl. ..... 34/15; 34/92; 34/104

[58] Field of Search ..... 34/15, 92, 104, 105; 68/5 L, 7, 20

[56] References Cited

U.S. PATENT DOCUMENTS

| | | | |
|---|---|---|---|
| 3,528,180 | 9/1970 | Karrer et al. | 34/9 |
| 3,650,676 | 3/1972 | Bergholtz | 8/155.1 |
| 3,914,962 | 10/1975 | Doire et al. | 68/20 |
| 3,927,478 | 12/1975 | Karrer et al. | 34/212 |
| 4,232,416 | 11/1980 | Burgin | 8/156 |
| 4,516,413 | 5/1985 | Barriquand et al. | 68/5 L |
| 4,545,135 | 10/1985 | Barriquand et al. | 34/105 |
| 4,590,683 | 5/1986 | Magin | 34/104 |

FOREIGN PATENT DOCUMENTS

| | | |
|---|---|---|
| 2074158 | 10/1971 | France . |
| 2195235 | 3/1974 | France . |
| 2359234 | 2/1978 | France . |
| 2519354 | 7/1983 | France . |

*Primary Examiner*—Albert J. Makay
*Assistant Examiner*—David W. Westphal
*Attorney, Agent, or Firm*—Oblon, Fisher, Spivak, McClelland, & Maier

[57] ABSTRACT

A method and installation for removing water from, drying and/or conditioning fibrous, porous or filament materials. A stream of gaseous fluid is caused to flow through an enclosure, by means of a plurality of flow means, so that it passes through the materials to be treated under reduced pressure and/or with over pressure, from the inside towards the outside of the materials, or vice versa, and a stream of water vapor is caused to pass through said materials so as to accelerate the removal of water at the beginning of drying and/or to rapidly raise the temperature of the treated materials and/or to spray said materials, if desired, during drying.

22 Claims, 26 Drawing Figures

V1
H1
A1
A2
H2
V2
V3
H3
A3
V4
H4
A4
H5
75
46
46a
40
41
41d
41e
42
44
45
45a
48
49
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140
43

V1
H1
A1
A2
H2
V2
V3
H3
A3
V4
H4
A4
H5
40
41
41d
41e
42
43
44
45
45a
46
46a
48
49
75
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140

V1
H1
A1
A2
H2
V2
A3
H3
V3
V4
H4
A4
H5
40
41
41d
41e
42
43
44
45
45a
46
46a
48
49
75
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140

V1
H1
A1
A2
H2
V2
V3
H3
A3
V4
H4
A4
H5
40
41
41d
41e
42
43
44
45
45a
46
46a
48
49
75
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140

V1
H1
A1
A2
H2
V2
A3
H3
V3
A4
H4
V4
H5
40
41
41d
41e
42
43
44
45
45a
46
46a
48
49
75
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140

V1
H1
A1
A2
H2
V2
V3
H3
A3
V4
H4
A4
H5
40
41
41d
41e
42
43
44
45
45a
46
46a
48
49
75
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140

V1
H1
A1
133
80
42
132
84
46
75
46a
40
41
41d
129
130
131
138
127
A2
H2
V2
V3
H3
A3
81
41e
125
126
83
83a
85
83b
121
122
82
124
123
45
45a
V4
H4
A4
H5
T
140
100c
100d
100e
100a
100b
99
120
128
43
87
88
89
86
92
102
101
139
90
44
93
94
96
95
97
91
98
135
137
136
49
48

V1
H1
A1
A2
H2
V2
V3
H3
A3
V4
H4
A4
H5
40
41
41d
41e
42
43
44
45
45a
46
46a
48
49
75
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140

45
45a
46
46a
75
40
41
41d
41e
42
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140
43
44
48
49
V1
H1
A1
A2
H2
V2
V3
H3
A3
V4
H4
A4
H5

V1
H1
A1
A2
H2
V2
V3
H3
A3
V4
H4
A4
H5
40
41
41d
41e
42
43
44
45
45a
46
46a
48
49
75
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140

V1
H1
A1
A2
H2
V2
A3
H3
V3
V4
H4
A4
H5
40
41
41d
41e
42
43
44
45
45a
46
46a
48
49
75
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140

V1
H1
A1
A2
H2
V2
V3
H3
A3
V4
H4
A4
H5
40
41
41d
41e
42
43
44
45
45a
46
46a
48
49
75
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140

V1
H1
A1
A2
H2
V2
V3
H3
A3
V4
H4
A4
H5
46
75
46a
40
41
41d
41e
45
45a
42
44
43
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140
48
49

V1
H1
A1
A2
H2
V2
A3
H3
V3
A4
H4
V4
H5
40
41
41d
41e
42
43
44
45
45a
46
46a
48
49
75
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140

V1
H1
A1
A2
H2
V2
V3
H3
A3
V4
H4
A4
H5
40
41
41d
41e
42
43
44
45
45a
46
46a
48
49
75
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140

V1
H1
A1
A2
H2
V2
V3
H3
A3
V4
H4
A4
H5
40
41
41d
41e
42
43
44
45
45a
46
46a
48
49
75
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140

V1
H1
A1
A2
H2
V2
V3
H3
A3
A4
H4
V4
H5
40
41
41d
41e
42
43
44
45
45a
46
46a
48
49
75
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140

V1
H1
A1
A2
H2
V2
V3
H3
A3
A4
H4
V4
H5
40
41
41d
41e
42
43
44
45
45a
46
46a
48
49
75
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140

V1
H1
A1
A2
H2
V2
V3
H3
A3
V4
H4
A4
H5
40
41
41d
41e
42
43
44
45
45a
46
46a
48
49
75
80
81
82
83
83a
83b
84
85
86
87
88
89
90
91
92
93
94
95
96
97
98
99
100a
100b
100c
100d
100e
101
102
120
121
122
123
124
125
126
127
128
129
130
131
132
133
135
136
137
138
139
140

METHOD AND INSTALLATION FOR REMOVING WATER FROM, DRYING AND/OR CONDITIONING FIBROUS, POROUS OR FILAMENT MATERIALS

BACKGROUND OF THE INVENTION

1. Field of the Invention

The invention relates to a method and installation for removing water from, drying and/or conditioning fibrous, porous or filament materials.

It applies to the removal of water from, to drying and/or conditioning of the most diverse fibrous materials, whatever form they take.

It applies, more particularly, to fibrous textile materials before spinning (in the form of flocks) during spinning (worsted yarns or tops), or after spinning (in the form of threads or filaments), as well as woven or knitted products.

The invention also applies to fibrous, porous or filament materials which are not textile materials such for example as non woven webs.

The invention is particularly well adapted to removing water from, drying and/or conditioning materials in the form of conical or cylindrical reels formed by winding a thread or filament on a perforated rigid or spring support or thread packets, that is to say volumes formed by winding threads or fibers without a support, or else yarns or filaments in the form of hanks.

2. Discussion of the Background

Water removal and drying installations are already known in which the two operations are carried out in one and the same enclosure, by forced air circulation through the material to be treated, alternately from the outside towards the inside and vice versa, with possible heating of the air at least during the drying phase.

The applicant has moreover already constructed such installations with or without a heat recovery device, whether this latter is of the air/water type, i.e. with production of hot water from the hot air leaving the dryer and which is cooled in said exchanger or of the air/air type, i.e. in which the hot air leaving the dryer is cooled while heating the incoming cold air, the heat being thus directly recovered from the dryer itself.

Other known installations, although they are satisfactory, are however generally provided for a specific use, both as to the materials to be treated are concerned and as to the treatment method and/or equipment, so that they do not have the characteristics of flexibility which are necessary at the present time, current practice requiring treatment of products of different natures and/or carrying out of a multiplicity of different treatments on the same material, or else using different treatment materials.

It is a general aim of the invention to provide a method for extracting water from, drying and/or conditioning fibrous, porous or filament materials as well as an installation for implementing such a method, in which the versatility is considerably increased, not only with respect to the different types of materials to be treated, but also to the different treatments which may be contemplated, or else to the equipment which may be used.

It is also an aim of the invention to provide a method and installation for implementing such a method which appreciably reduces the time for treating the materials while ensuring an excellent quality of the products obtained;

Finally, a further aim of the invention is to provide a method and installation for implementing such a method for carrying out the necessary treatments on fibrous, porous filament or similar materials, in a multiplicity of different modes, depending on the wound or packaged types of presentation of said materials and/or depending on the desiderata of practice for obtaining in each case the best possible results.

SUMMARY OF THE INVENTION

A method according to the invention for removing water from, drying and/or conditioning fibers, porous or filament materials, in which the water removal and drying operations are carried out in one and the same enclosure by forced air circulation, with possible heating thereof at least during the drying phase, is characterized in that:

a gaseous fluid stream is moved through an enclosure, using one or more flow means, so that it passes through the materials to be treated under a lowered and/or boosted pressure (over pressure), from the inside towards the outside of said materials, or vice versa, a stream of water vapor is caused to pass through said materials so as to accelerate the removal of water at the beginning of drying and/or to rapidly raise the temperature of the treated materials, and/or to spray, if required, said materials during drying, the drying air is humidified, if desired, by means of pressurized water, by spraying or by another humidification means, if desired finishing products intended to be deposited on the materials to be treated are sprayed into the drying air; and at the end of drying the materials are reconditioned, if desired by causing fresh ambient air to flow therethrough under a lowered and/or boosted pressure with or without addition of pressurized water, by spraying or by another humidification means.

Implementation of the method with circulation of a gaseous fluid under reduced pressure is particularly advantageous in that it lowers the boiling temperature of the water while maintaining a stream of gaseous treatment fluid, contrary to known embodiments in which the treatment enclosure is connected to a vacuum tank or to a vacuum pump.

In the case of causing a gaseous fluid to flow using a plurality of flow means, these flow means may be configured either in series or in parallel.

In the case, also, of the use of a plurality of flow means for causing the fluid to flow, said flow means are advantageously adapted so that at least one causes the gaseous treatment fluid to penetrate into the enclosure under increased pressure whereas at least one other of said means controls discharge of the fluid from the enclosure under reduced pressure.

Whatever the method of use, it is anticipated the compressed air may be introduced, if desired, into the gaseous fluid stream.

The method of the invention is particularly advantageous when applied to the treatment of hanks or similar volumes of material.

In such a case, the invention provides top to bottom and/or bottom to top flow of the gaseous treatment fluid through the suspended hanks.

An installation according to the invention, for removing water from, drying and/or conditioning fibrous, porous or filament materials, comprising a single enclosure in which said materials are adapted to be placed, means for causing a gaseous fluid to flow through said materials as well as means for heating the drying air, is characterized in that the means for causing the gaseous fluid to flow are adapted so as to cause it to flow in the enclosure so that it passes through the material to be treated under a reduced and/or boosted pressure, from the inside towards the outside of said materials, or vice versa, and in that it comprises means for introducing water vapor into the gaseous fluid flow ducts for causing said vapor to pass through said materials so as to accelerate water removal at the beginning of drying and/or for rapidly raising the temperature of the materials during treatment and/or spraying said materials during drying, means for humidifying the drying air, means for spraying therein finishing products intended to be deposited on the treated materials and, if desired, compressed air injection means.

In one embodiment, the means for causing the flow of gaseous fluid comprise advantageously a plurality of means for causing forced flow of said fluid through the fibrous, porous, filament or similar materials during treatment.

In one embodiment, the means for causing forced flow of the fluid function in series.

In a variant, the means for causing forced flow of the fluid function in parallel.

In a preferred embodiment of the installation, the means for causing forced flow of the fluid, the ducts connecting said means to the enclosure as well as members for opening and/or closing said ducts, such as valves or the like, are organized so that the gaseous fluid passes through the materials to be treated under reduced pressure.

In the case of a plurality of flow means, they may act in series for discharging the gaseous fluid from the enclosure in which the gaseous fluid flows through the materials to be treated under reduced pressure.

In the alternative, the flow means may act in parallel for removing the gaseous fluid from the enclosure in which the fluid passes through the materials to be treated under a reduced pressure.

In either of these cases, the gaseous fluid flow may take place from the inside towards the outside of said materials to be treated.

In the alternative, in either or both of these cases, the gaseous fluid flow may take place from the outside towards the inside of said materials to be treated.

In one embodiment of the invention, in the case of a plurality of flow means, said means, the ducts connecting said means to the enclosure and the members for opening and/or closing said ducts are arranged so that the gaseous treatment fluid penetrates into the enclosure under increased pressure, under the action of at least one of said flow means whereas it is discharged from said enclosure under reduced pressure by at least another of said flow means.

In such an embodiment, the flow of the gaseous fluid may take place from the inside towards the outside of the materials to be treated.

In the alternative, the gaseous fluid flow may take place from the outside towards the inside of said materials.

The gaseous flow, in another alternative, may flow through the materials to be treated under increased pressure, whether the flow means act in series or in parallel, in the case of a plurality of flow means.

In accordance with the invention, and particularly for reconditioning the treated materials at the end of drying, the flow means, the ducts connecting said means to the enclosure as well as the members for opening and/or closing said ducts are arranged so that the gaseous fluid flow—which is then advantageously fresh ambient air with or without addition of pressurized water, by spraying or by another humidification means—takes place with partial or total recycling.

For this reconditioning phase, also, the gaseous fluid preferably passes through the materials to be treated under reduced pressure, from the inside to the outside, or vice versa.

In this case, a large amount of air passes through the materials to be treated before passing into the flow means, which means that the air can flow through the materials at ambient temperature and at ambient humidity .

In the case of a plurality of flow means, and also for this reconditioning phase, said flow means may act in series or in parallel.

In a preferred embodiment, the single treatment enclosure is provided with means for distributing the gaseous fluid introduced and/or removed from said enclosure through the materials to be treated, whether these materials are in the form of reels, in the form of thread packets, packages, flocks or similar volumes.

In another preferred embodiment, the installation is provided with means for treating yarns or filaments in the form of hanks.

In this case, and in particular when the hanks are suspended from material carrying bars, the flow of gaseous treatment fluid in the tank advantageously takes place from top to bottom through the suspended hanks.

In the alternative, and for certain types of yarns in hanks, the flow may take place in both directions, from top to bottom and from bottom to top.

Also in accordance with the invention, the enclosure in which the materials are placed for treatment thereof are provided with removable centering means, readily positioned for centering in said enclosure the material-carrying devices on which the materials are disposed prior to their treatment.

In one embodiment, these centering means are formed by bent rods which differ from each other by the length of a bent upper leg and which are adapted for cooperating with a ring and/or a circular sector fixed to the inside of the enclosure, at least the circular sector having holes for receiving ends of said rods and which are spaced apart in a plurality of concentric circles having decreasing diameters with increasing distance from the wall of the enclosure.

Material-carrying devices having differing structure or dimensions may thus be readily placed in the enclosure. Clamping, centering and locking means are provided on the removable cover and accommodate for differences in height and form of the fluid passage channels or the like of the material-carrying devices.

To this end also, on the one hand, sealing means are provided and, on the other, the means for distributing the gaseous treatment fluid inside the enclosure are so dimensioned such that the enclosure may accomodate all the desired material carriers.

Thus the sealing connection of the fluid flow channels or the like of the material carriers with those of the installation is guaranteed, as is the satisfactory required positioning of the material carriers in said enclosure.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Reference is made first of all to FIGS. 1 to 6*b* illustrating the structure of an installation according to the invention for removing water from, drying and/or conditioning fibrous or similar materials. It comprises a treatment tank 45, generally cylindrical in shape, which may be sealingly closed at its upper part by a removable quick opening and closure lid 75. Tank 45 is provided for housing a material carrier device 46 comprising, in a first embodiment and in a way known per se, a column 46*a* pierced with a multiplicity of orifices, not shown, allowing the gaseous fluid to pass between a longitudinal axial channel 40 in said column and the space inside tank 45, the flow through the fibers, porous or filament material to be treated taking place from the outside towards the inside of the windings, supports or packages, or vice versa.

Figure 2:
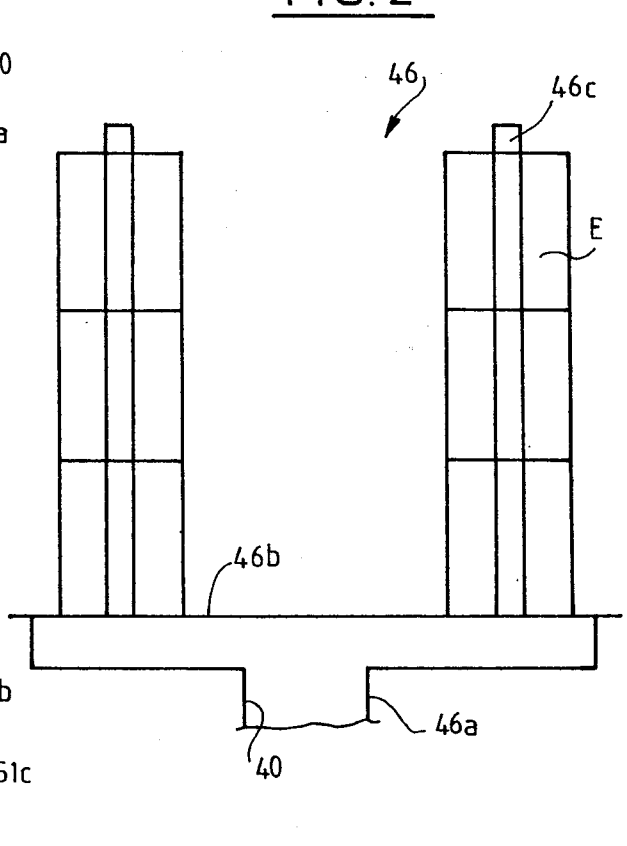
FIG. 2 is a partial schematical view of a material carrier adapted to be used in an installation according to the invention.

In another embodiment, FIG. 2, the material carrier device 46 is in the form of a plate 46*b* on which are erected a plurality of columns 46*c* of smaller diameter than column 46*a* so that the gaseous fluid flowing through channel 40 is distributed in the columns 46*c* which carry, in stacked relation, the windings E of material to be treated in the form of threads or filaments disposed on their rigid perforated or spring supports, not shown, said windings being formed from threads, roves, combed tops, woven or knitted tops, knitted or woven wear.

In the case of knitted or woven wear the supports of the windings, depending on the case, are horizontal.

Figure 1:
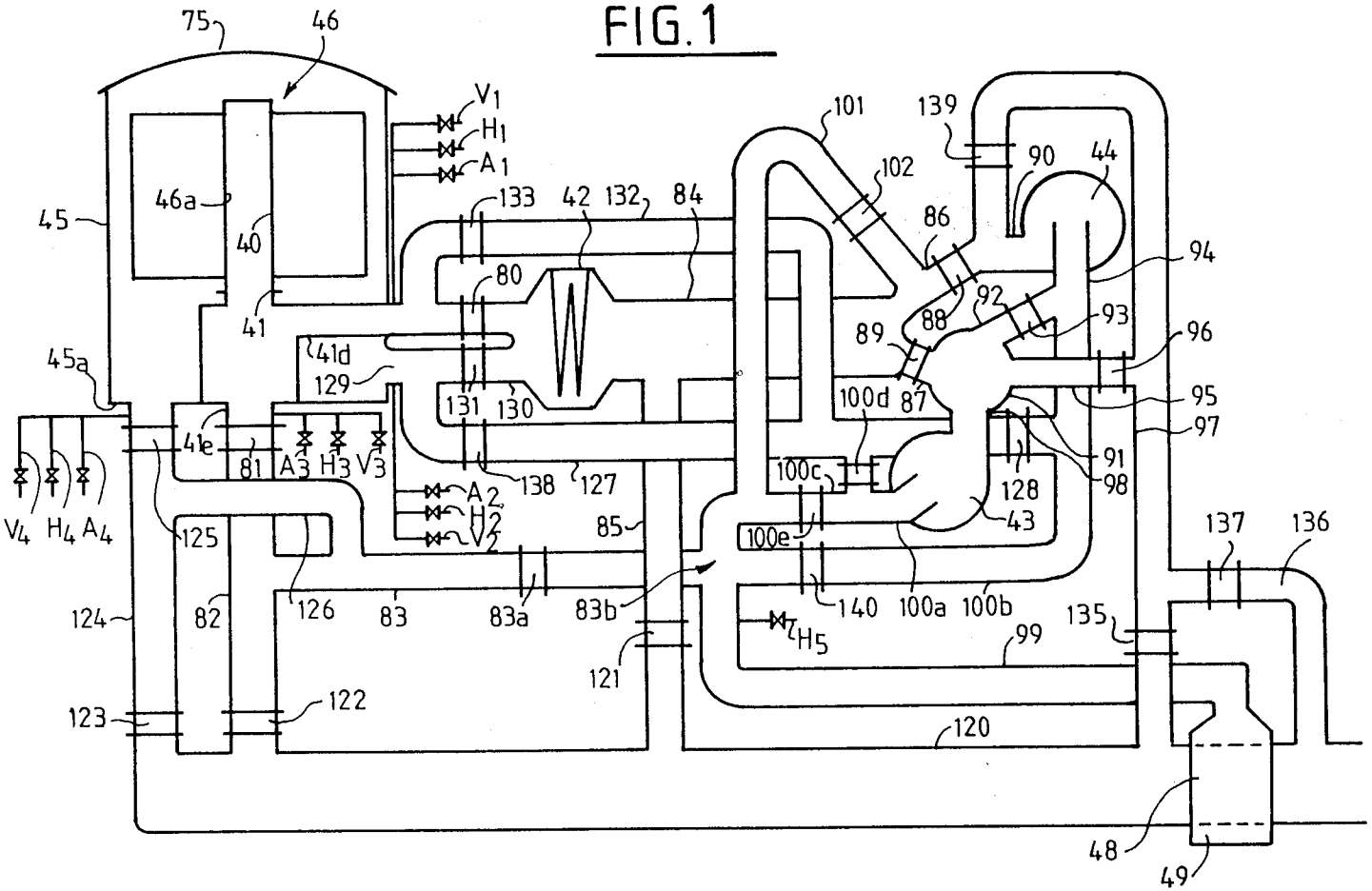
FIG. 1 is a general schematical view of an installation for extracting water from, drying, and/or conditioning fibrous, porous or filament materials in accordance with the invention.
Figure 3:
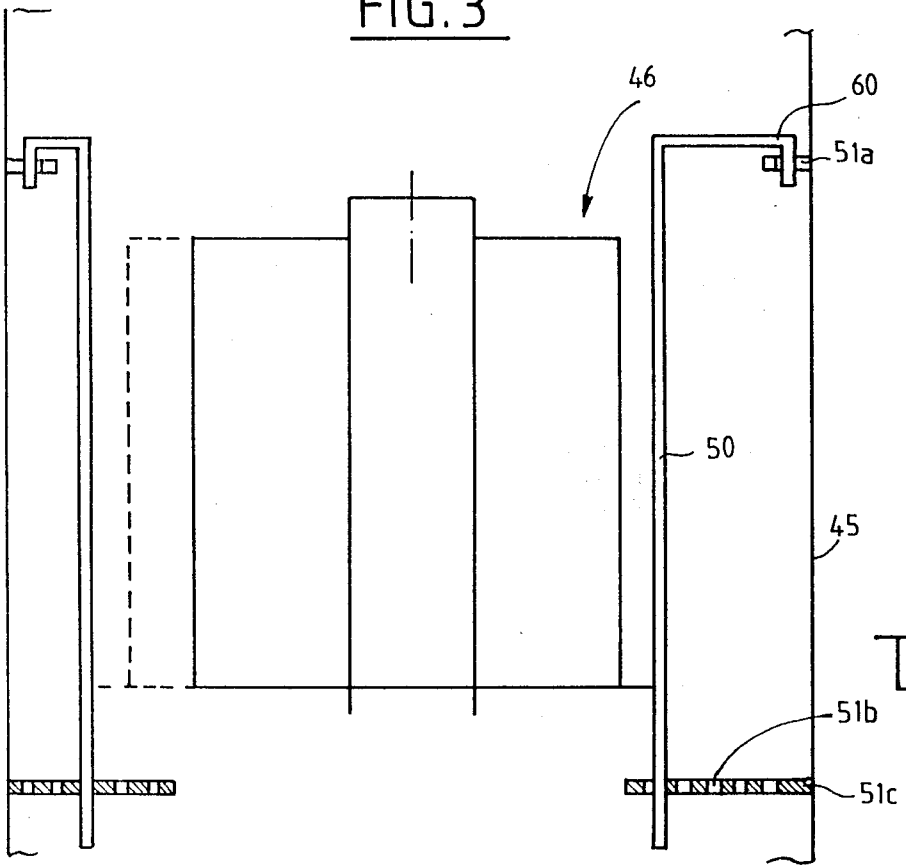
FIG. 3 is a partial schematical view of an enclosure for receiving materials to be treated of an installation in accordance with the invention.

As shown in FIG. 3, and both for the embodiment shown in FIG. 1 and for that shown in FIG. 2, centering means are provided in tank 45 and formed for example, by a plurality of bent rods 50, advantageously having circular cross sections, each being bent so as to form an upper leg 60 and a lower leg, an end of each upper leg 60 being further bent and received in perforations of an annular support 51*a* fixed to the side wall of tank 45 at the top part thereof. The lower ends of the lower legs of the rods 50 are respectively introduced into one of a plurality of holes 51*b* of a circular sector 51*c* also fixed to the internal side wall of the tank 45, spaced from the ring 51*a*. The holes 51*b* are spaced apart in a plurality of concentric circles of diameters that decrease with increasing distance from the wall of the tank so that when the rods 50, which differ from each other by the lengths of their upper legs 60, are positioned on the ring 51*a* and on sector 51*c*, a structure is obtained somewhat similar to a squirrel cage for centering the material carriers 46 of different diameters, as shown in the right and left hand parts of FIG. 3.

Figure 5:
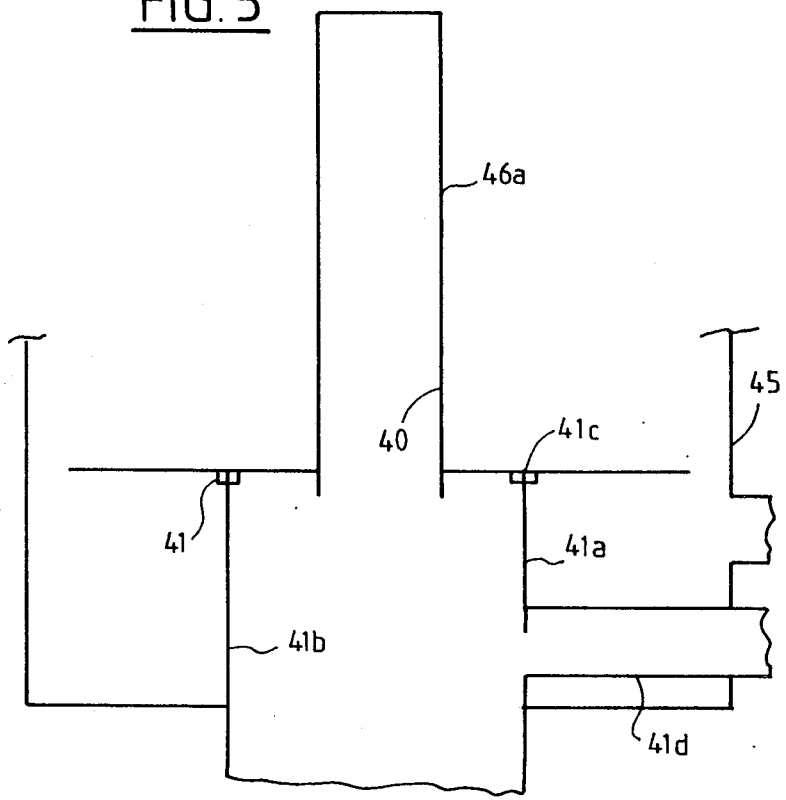
FIG. 5 is a view similar to that of FIG. 4.
Figure 4:
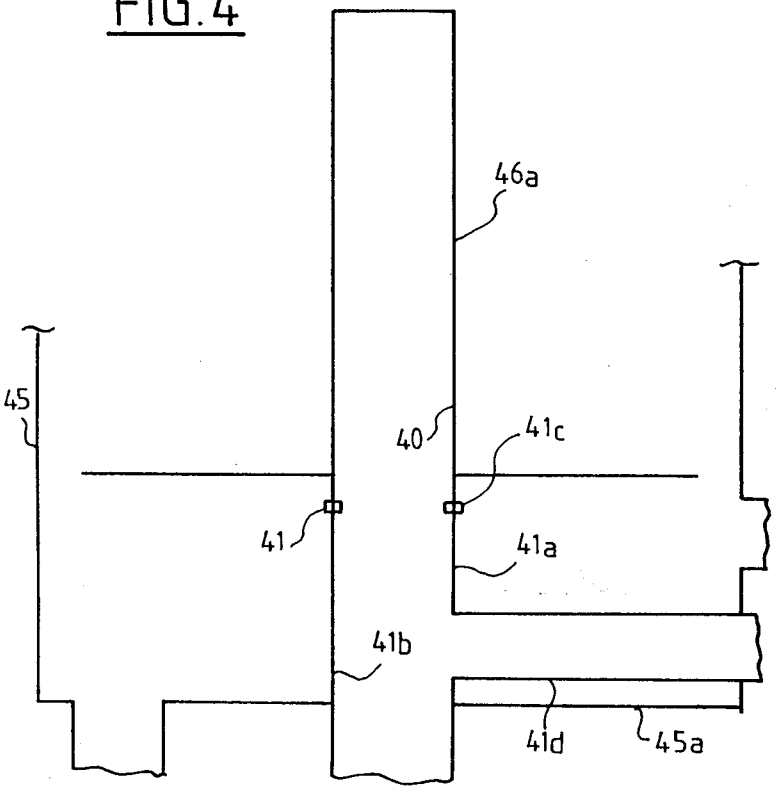
FIG. 4 is a view similar to that of FIG. 3, for another part of the enclosure and for a variant.
Figure 6:
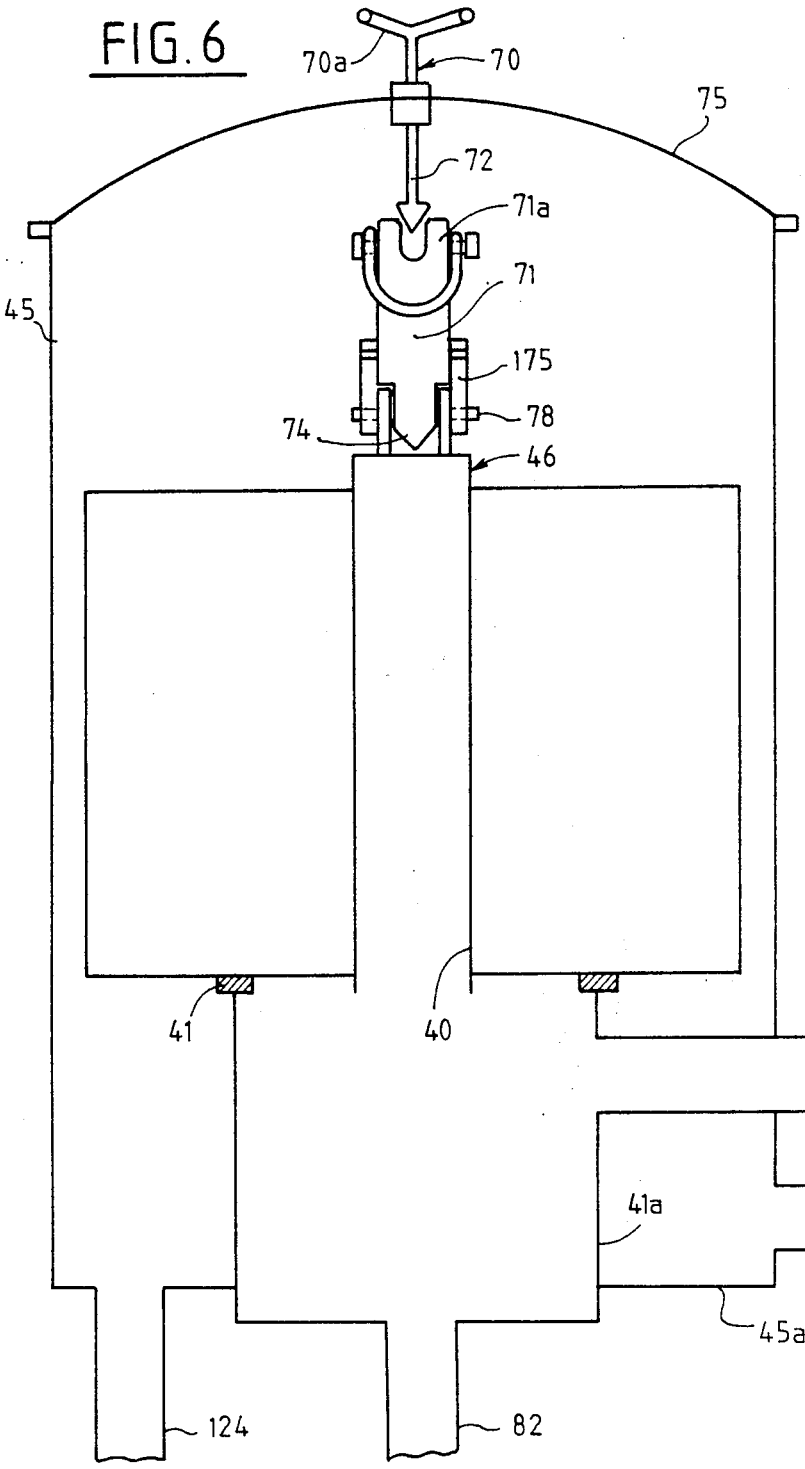
FIG. 6 is a schematical view of an enclosure for receiving materials to be treated of an installation in accordance with the invention.

At a distance from the bottom 45*a* of tank 45 there opens into this latter, as shown at 41, a distribution member 41*a*, FIGS. 4, 5 and 6. In the embodiments of FIGS. 1 and 4, said distribution member 41*a* has dimensions similar to those of column 46*a*, so that, after the positioning and centering of the material carrying device in the tank, the channel 40 of column 46*a* extends the channel 41*b* of the distribution member 41*a* for forming a continuous gaseous fluid passage intended to pass through the fibrous, porous, filament and/or similar materials being treated.

A seal 41*c* is provided, if necessary, at the junction of channels 40 and 41*b*.

In the embodiment of FIGS. 5 and 6, the diameter of the distribution member 41*a* is larger than that of column 46*a*, so that material carriers having columns 46*a* of different dimensions may cooperate with said distribution member, provided that the longitudinal channel 40 of said columns has a diameter less than that shown at 41*b* of member 41*a*.

Sealing means 41*c* may be provided, FIGS. 5 and 6. For providing good sealing with respect to the gaseous fluids flowing in the distribution member 41*a* and in channel 40, the invention provides complementarily FIGS. 6 and 6*a*, a device 70 mounted on the lid 75 of tank 45. The device 70 comprises a hand wheel 70*a* which drives a rod 72 which cooperates with the head 71*a* of an assembly 71 associated with a material carrier 46 for applying a clamping force for forcing said material carrier against the sealing means 41*c*.

Figure 6A:
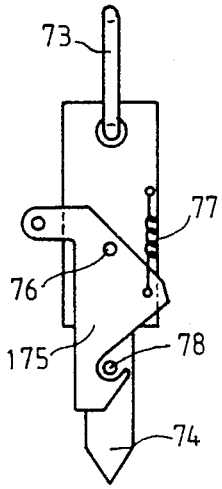
FIG. 6*a* is a detailed view.

Assembly 71 also comprises, as can be clearly seen in FIG. 6*a*, a lifting ring 73 and, on each side of a centering pin 74, hooks 175 mounted for pivoting about a shaft 76 against the action of spring 77 and adapted for cooperating with studs 78 integral with the material carrier for removable locking thereof.

Figure 6B:
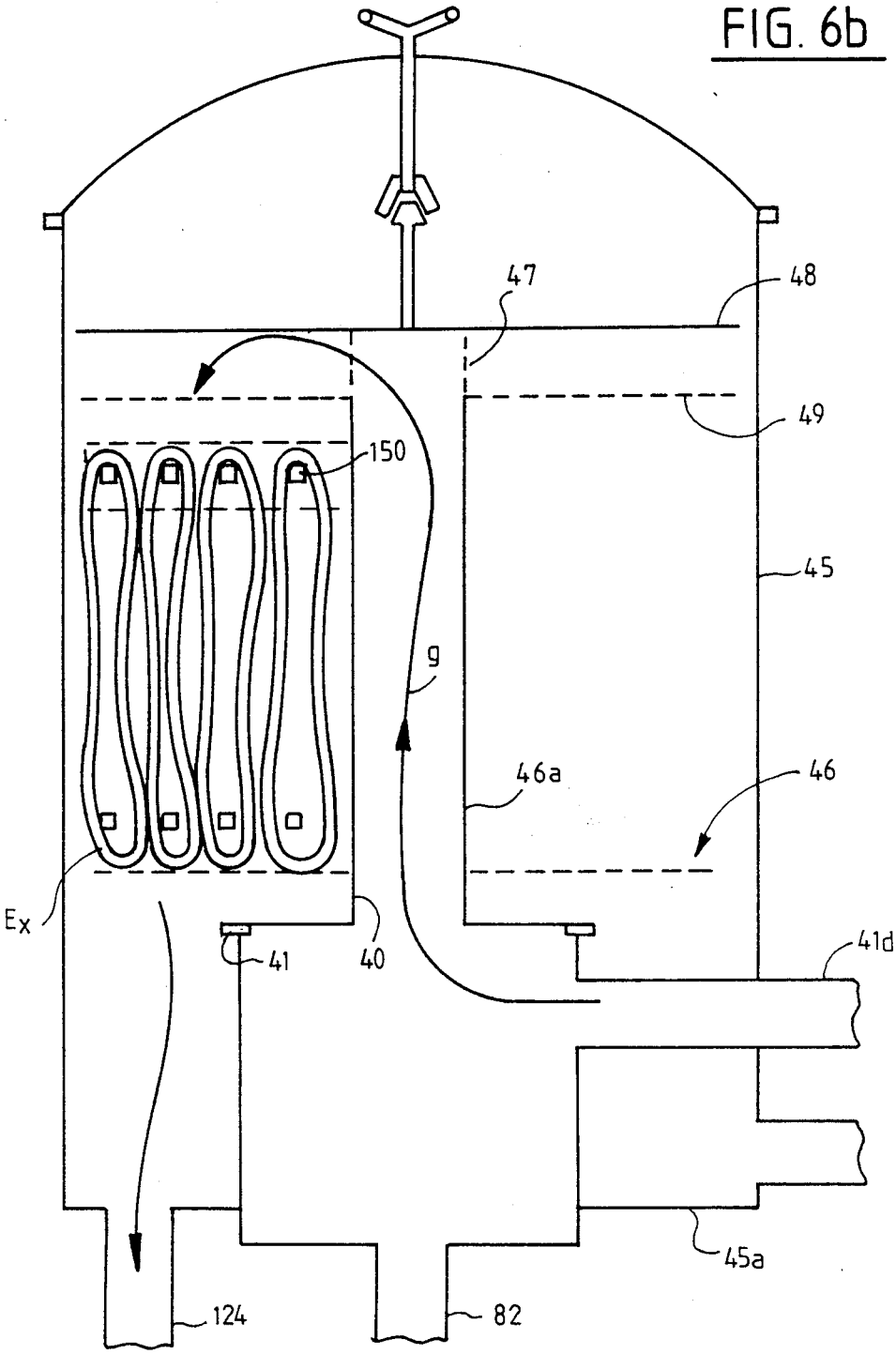
FIG. 6*b* is a view similar to that of FIG. 6, but for another embodiment.

In the embodiment shown in FIG. 6*b*, designed more particularly in accordance with the invention for treating materials in the form of hanks, the material carrier is provided with bars 150 from which the hanks Ex are suspended and column 46*a* is extended at its upper part by a perforated extension 47 extending between a solid end plate 48 and a lower plate 49, also perforated, for letting the gaseous treatment fluid flow therethrough along the path shown by the arrow g, that is to say through channel 40, extension 47, plate 49 and the hanks Ex disposed on the bars 150 placed on the plate 49. With these preceding arrangements, tank 45 may receive material carriers which differ from each other by their diameter, their height or else the dimensions of column 46*a* and of the longitudinal channel 40, so that the installation of the invention is thus made versatile in this respect.

The installation further comprises, joined end to end with the distribution member 41*a*, a duct 41*d* and a duct 41*e*, the first one being connected through a valve 80 or the like to a heat generator 42, whereas the second duct 41*e* is connected through a valve or the like to a duct 82 into which is tapped a duct 83 which, beyond a valve 83*a* or the like, leads to a connection 83*b* of ducts which will be described hereafter.

The heat generator 42 may be a heat exchanger fed with vapor or a heat exchanger fed with a heat carrying fluid, such as superheated water, or else may be in the form of an electric heating means, or in the form of a gas burner with direct heating, or else in the form of a gas heater with indirect air heating.

Whatever the embodiment chosen, the heat generator 42 is connected, at the end opposite the one connected to duct 41*d*, to a duct 84 into which a duct 85 opens and which, at its end opposite that connected to the heat generator 42, is divided into branches 86 and 87. The first branch 86 is connected through a valve 88 or the like to an outlet duct 97 having a valve 139 and also is connected to the outlet pipe 90 of an air flow means 44, for example a booster, a fan, a compressor or the like. The second branch 87 is connected through a valve 89 or the like to a distributor 91. To the distributor 91 are connected a duct 92, a duct 95 and an outlet duct 98 of a second flow means 43, similar to air flow means 44. The duct 92 communicates through a valve 93 or the like with an intake pipe 94 of the air flow means 44. The duct 95 communicates through a valve 96 or the like with the duct 97.

In a variant, not shown, the installation comprises not only two air flow means but a plurality of such means.

The intake of air into the installation is made through a filter 49 for removing impurities, a heat exchanger 48 adjacent said filter being provided for recovering the heat from the outgoing air by heating the incoming air.

The outlet 99 of the filter-exchanger assembly is connected to the connection 83*b* from which extend an intake duct of 100*a* of the air flow means 43 and a duct 100*b* connected to the intake pipe 94 of the air flow means 44, with interpositioning in said duct 100*b* of a valve 140 or the like. Form connection 83*b* there also extends a duct 101 having a valve 102 or the like. Duct 101 opens into duct 86 so that the air coming into the installation may be conveyed either by ducts 99, 100*b* and 94 to the inlet of the flow means 44, or through ducts 99 and 100*a* to the inlet of the flow means 43, or else through ducts 99 and 101 to the heat generator 42, or finally, from duct 100*a* and a bypass 100*c* provided before the inlet into the flow means 43 and in which is inserted a valve 100*d*, simultaneously to the air flow means 43 and 44.

The heat exchanger 48 is connected to an air outlet duct 120, which may be placed in communication by a valve 121 or the like, on the one hand, with duct 85 connected to the heat generator 42 and, on the other hand, through valves 122 and 123 or the like, respectively, with duct 82 which is connected, through the distribution member 41*a*, to the channel 40 of column 46*a* of the material carrier and to a duct 124 in which is inserted a valve 125 or the like connecting said duct to the bottom 45*a* of the treatment tank 45.

As can be seen in FIG. 1, the installation also comprises a duct 126 between duct 124 and duct 83, as well as a duct 127 connecting, through a valve 138 or the like, the inside of tank 45 either with duct 100*c* or, through a valve 128, to pipe 94, said duct 127 being mounted in parallel, from the outlet 129 of tank 45, with another duct 130 which is connected to the heat generator 42 through a valve 131.

A duct 132 in which is inserted a valve 133 also connects duct 41*d* to duct 127. Duct 97 is connected to duct 120 upstream of the heat exchanger 48, the same duct 97 gain being connected to the same duct 120, downstream of the heat exchanger 48, by a duct 136. The communication of duct 97 and duct 120 at the upstream side of the heat exchanger is governed by the opening and/or closing of a valve 135 or the like, whereas in duct 136 is inserted a valve 137 or the like.

Also in accordance with the invention, means $V_1$, $V_2$, $V_3$ and $V_4$ are provided connected to the pressurized vapor generator for introducing vapor into the installation and, more precisely, in duct 41*d* for device $V_1$, in duct 127 for device $V_2$, in duct 41*e* for device $V_3$ and in duct 124 for device $V_4$.

Similarly, devices referenced respectively $H_1$, $H_2$, $H_3$, $H_4$ and $H_5$ are provided for introducing pressurized and sprayed water into the installation, devices $H_1$, $H_2$, $H_3$, $H_4$ being placed in correspondance with the devices V bearing the same indices, whereas device $H_5$ allows pressurized and sprayed water to be introduced into the duct 99 intaking air into the installation, downstream of the heat exchanger 48, in the flow direction of the gaseous fluid.

Finally, an assembly of devices $A_1$, $A_2$, $A_3$, $A_4$ open into the ducts of the installation in correspondence with the devices V and H bearing the same indices and allow pressurized and sprayed finishing products such as oiling products to be added to the gaseous treatment fluids. Means, not shown, are provided for introducing compressed air into the ducts.

An installation such as described above may be used in different ways, depending on the final desired effect of the treatment, by modifying the flow conditions of the gaseous fluids as well as by a choice of the characteristics of said fluids charged or not with conditioning and/or reconditioning products.

In what follows, there will be described by way of non limitative example several methods of using the installation with reference to FIGS. 7 to 24, in which the path of the gaseous fluids is shown by arrowed lines.

EXAMPLE 1

Figure 7:
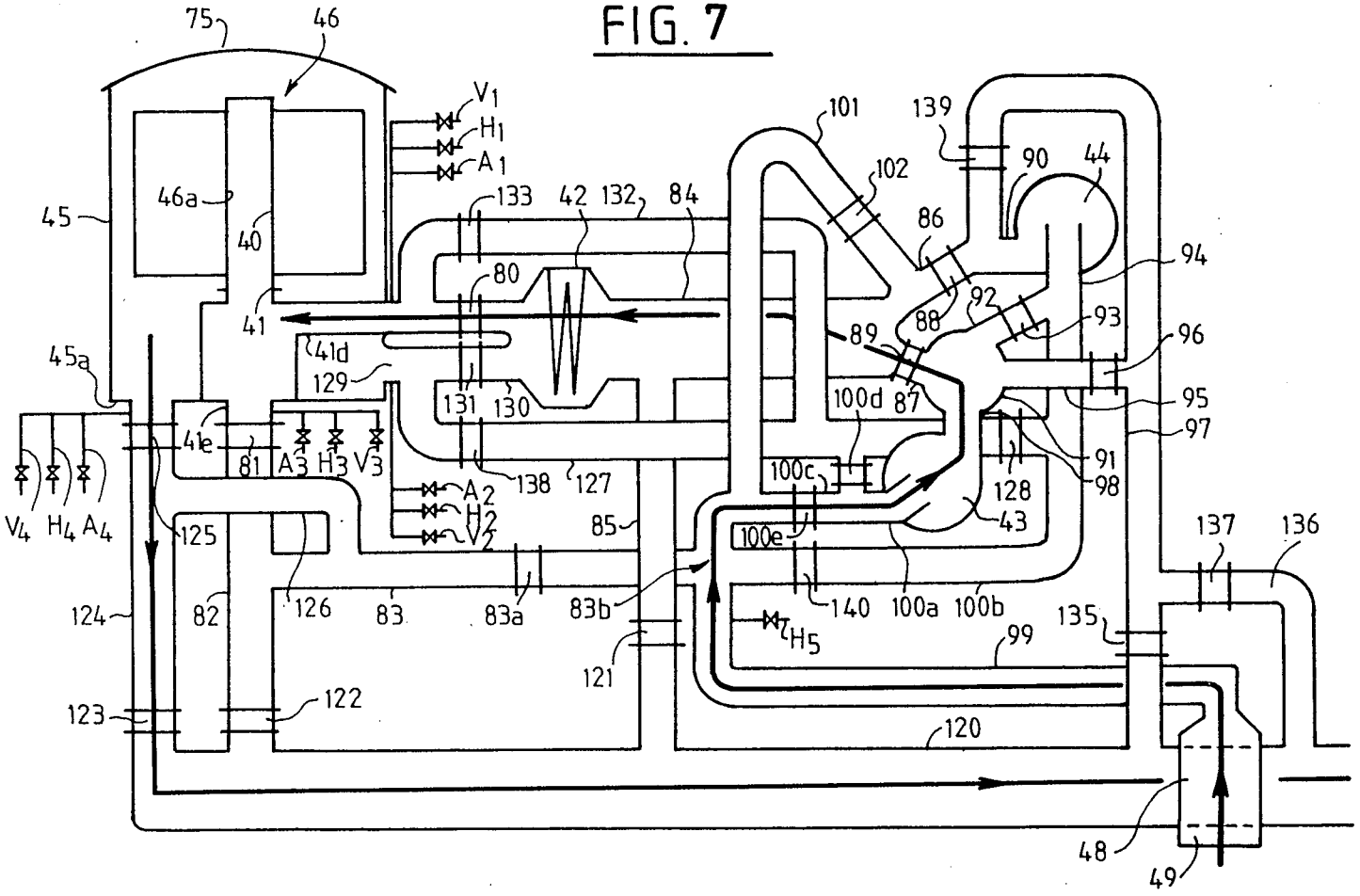
FIGS. 7 to 24 are diagrams of an installation according to the invention, similar to that of FIG. 1 and illustrating the flow of the fluids used.

In this example, FIG. 7, a single air flow means is used, namely means 43 for causing the air coming into the installation to flow through the filter 49 along a path going, under increased pressure, from the inside to the outside of the material to be treated, whether the windings are on reels or in the form of packets.

In this example, the air flow from the heat exchanger 48 takes place through duct 99, duct 100*a*, the flow means 43, branch 87, duct 84, the heat exchanger 42 at the outlet of which the air penetrates into duct 41*d* then, through channel 40, where it passes through the material to be treated before escaping, through valve 125, into duct 124 from which it reaches the outlet duct 120 through the valve 123.

EXAMPLE 2

Figure 8:
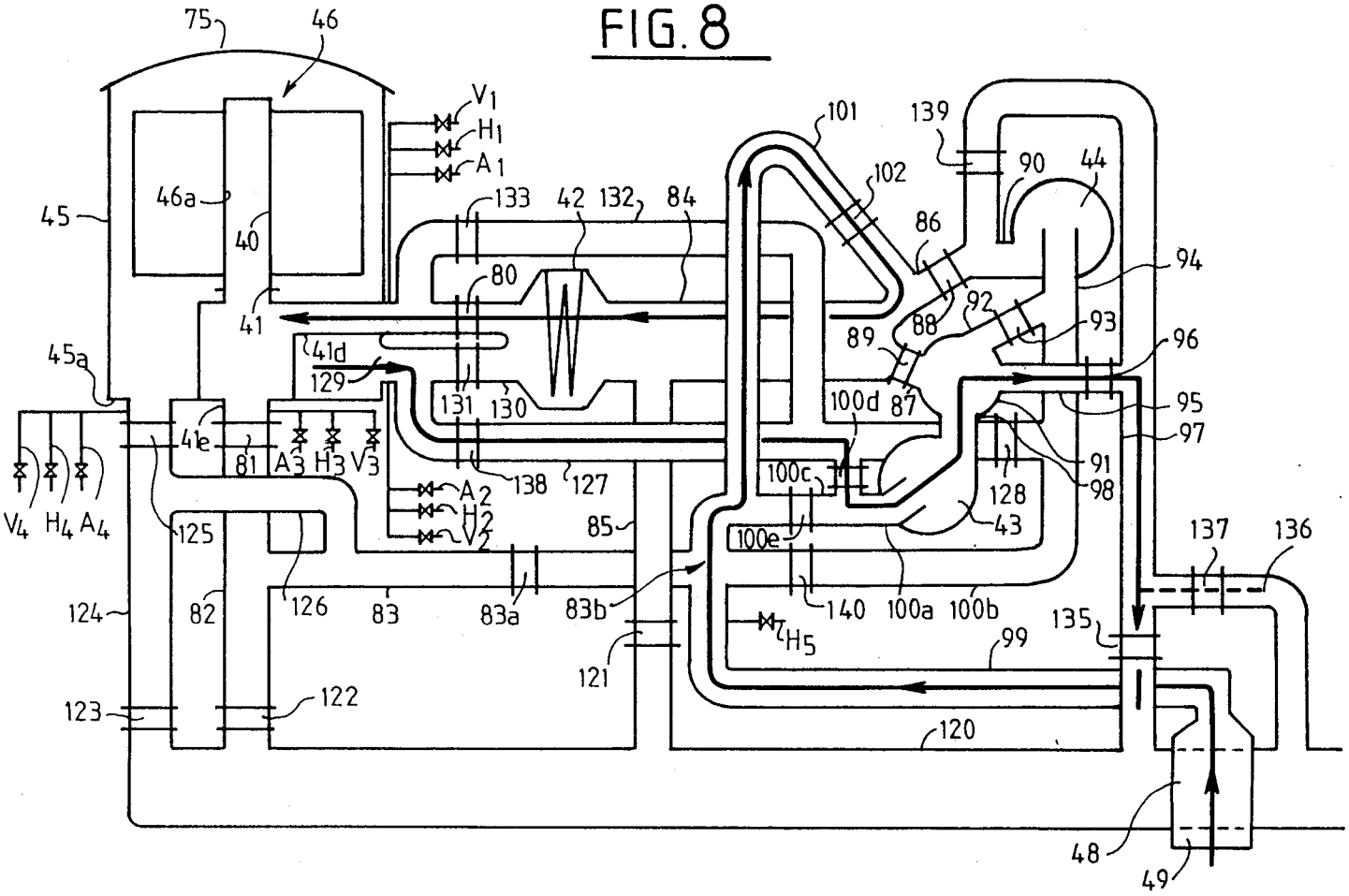

In this embodiment, FIG. 8, the flow of gaseous fluids takes place from the inside to the outside of the windings of material to be treated, as in the preceding example, however not under an increased pressure but by suction, that is to say that the fluid passes through the material under reduced pressure.

From the heat exchanger 48 the gaseous fluid flows through ducts 99, 101, branch 86, duct 84 through which it penetrates into the heat generator 42 then, through channel 40, into the material to be treated at the outlet of which it leaves the treatment tank through orifice 129, is taken up by duct 127 after passing through valve 138, duct 100*c*, the intake pipe 100*a* of the flow means 43, distributor 91, duct 97 and, through valve 135, as far as the outlet duct 120.

EXAMPLE 3

Figure 9:
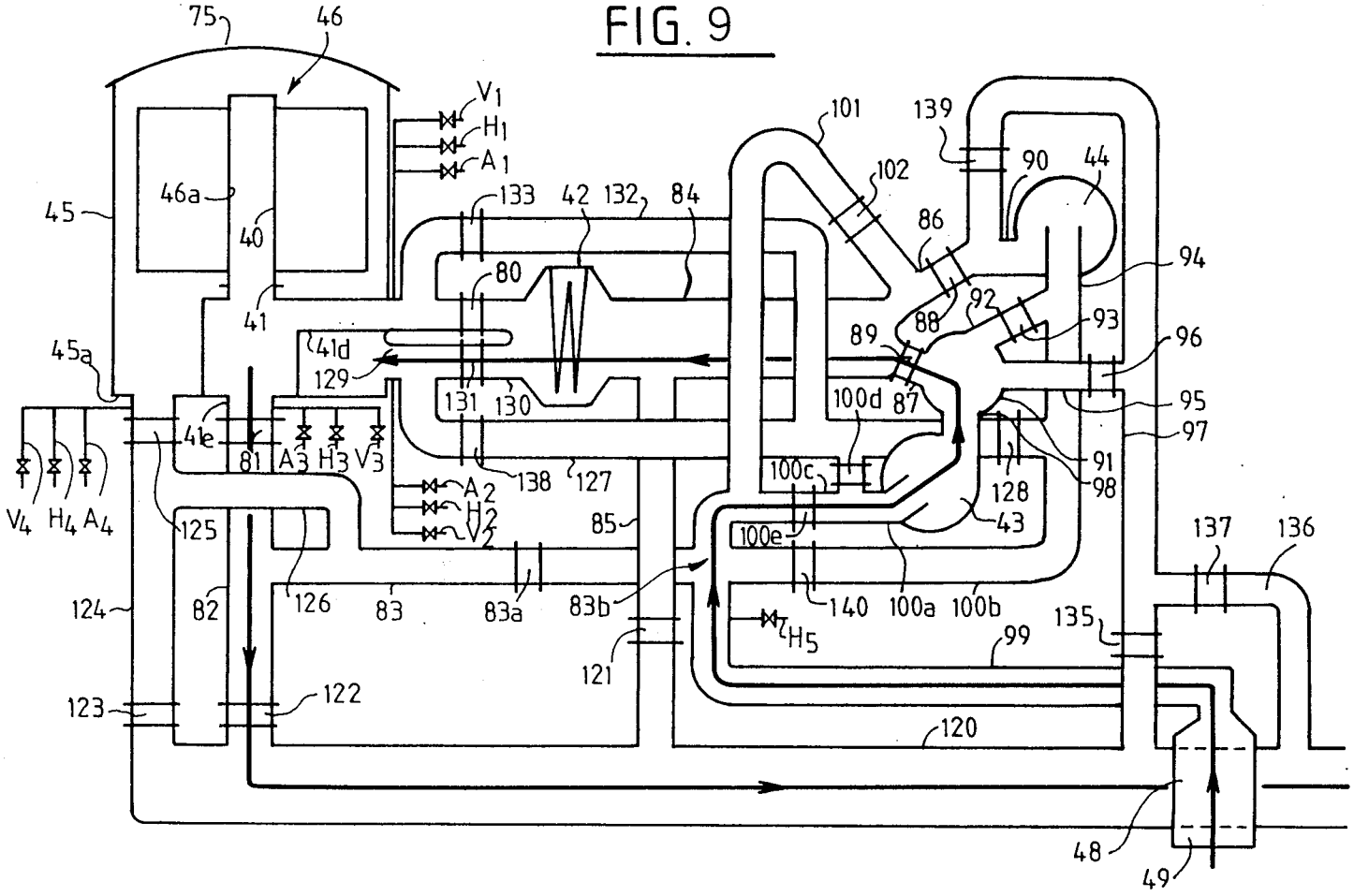

In this case, FIG. 9, the gaseous fluid flows through the material to be treated from the outside of the windings to the inside thereof, the path then being defined from the heat exchanger 48 through duct 99, the intake pipe 100*a* of the flow means 43, distributor 91, branch 87, duct 84 leading the gaseous fluid through the heat generator 42, the inlet into the treatment tank 45 through duct 130 and valve 131 as far as opening 129. After passing through the material to be treated from the outside to the inside of the windings, the gaseous fluid passes through channel 40 and leaves the treatment tank through duct 41*e*, valve 81, duct 82, valve 122 and finally duct 120.

EXAMPLE 4

Figure 10:
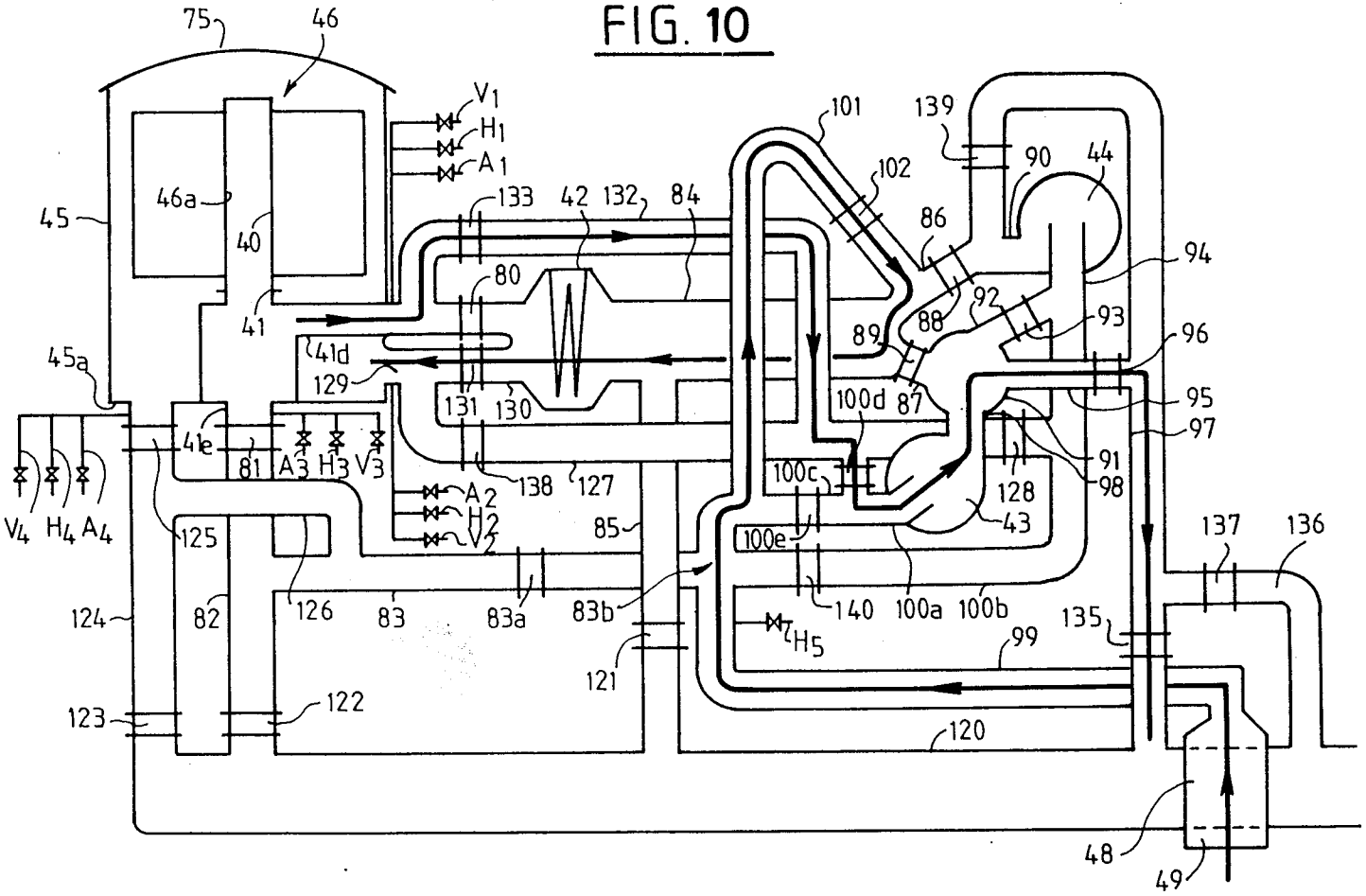

In this application, FIG. 10, the gaseous fluid flows through the material to be treated from the outside to the inside but, contrary to the application of example 3, under a reduced pressure and not an over pressure.

The path of the gaseous fluid, from the heat exchanger 48, is then that comprising duct 99, duct 101, branch 86, the inlet duct 84 of the heat generator 42, duct 130 bringing hot air inside tank 45 and on the outside of the material to be treated. When the gaseous fluid has passed through the material and has penetrated into channel 40, it is then removed through valve 133, duct 132, valve 100*d*, duct 100*c* and the intake pipe 100*a* of the flow means 43 from where it leaves as in example 2.

EXAMPLE 5

Figure 11:
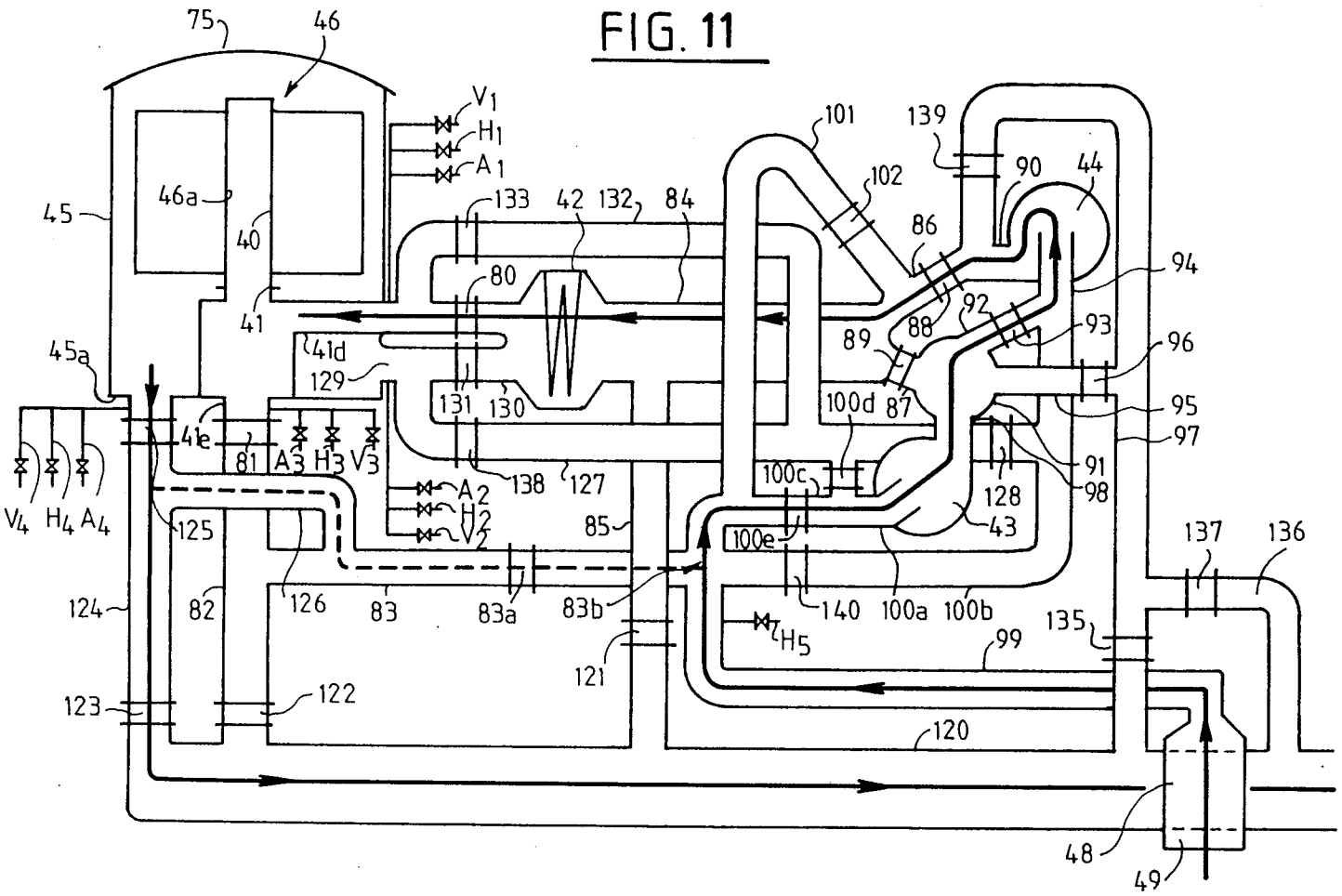

In this mode of use, FIG. 11, the invention uses not just a single air flow means but two air flow means, simultaneously and in series, for causing the gaseous fluid to pass through the material to be treated from the inside towards the outside under an over pressure.

After passing through the heat exchanger 48 the fluid is brought by ducts 99 and 100*a* into the first flow means 43 then, through distributor 91 and pipe 92, to the intake pipe 94 of the second flow means 44. The outlet from this latter is through pipe 90 and branch 86 from where the fluid penetrates into duct 84, passes through the heat generator 42 and reaches channel 40 through valve 80 and duct 41*d*.

After passing through the material to be treated from the inside towards the outside of the windings, the gaseous fluid leaves tank 45 through valve 125, duct 124, valve 123 and duct 120.

In a variant, by opening valve 83*a*, a bypass of the outgoing fluid is established using duct 126 so that, as shown with a broken line in FIG. 11, the bypassing fluid arrives at the branch 83*b*, thus defining a recycling operational mode.

EXAMPLE 6

Figure 12:
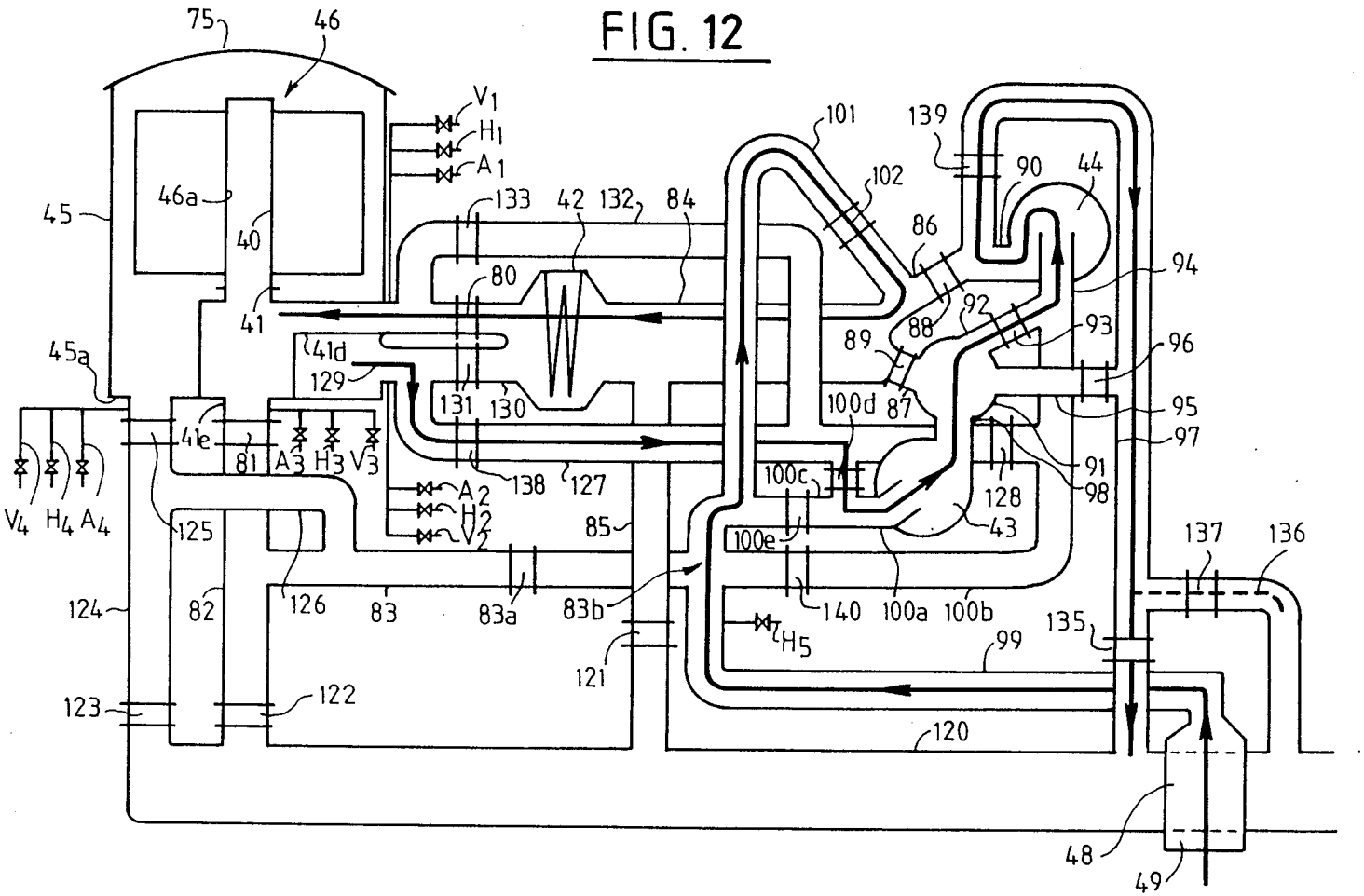

In this mode of operation, and as in the preceding example, the two fluid flow means 43 and 44 are operational in series, FIG. 12.

On the other hand, and as opposed to example 5, suction is used here, the fluid path being formed from the heat exchanger 48, through duct 99, duct 101, branch 86, duct 84, heat generator 42, duct 41*d*, channel 40. From this latter, the gaseous flow passes through the materials to be treated from the inside to the outside of the windings, then escapes from tank 45 through orifice 129, duct 127, duct 100*c*, the intake pipe 100*a* of flow means 43, distributor 91, the intake pipe 94 of the second flow means 44 then leaves this latter through duct 90, valve 139, duct 97 and the discharge duct 120 after passing through valve 135.

In a variant, and as shown with a broken line at the right hand part of FIG. 12, the invention also provides, by opening valve 137, complementary discharge through duct 136.

EXAMPLE 7

Figure 13:
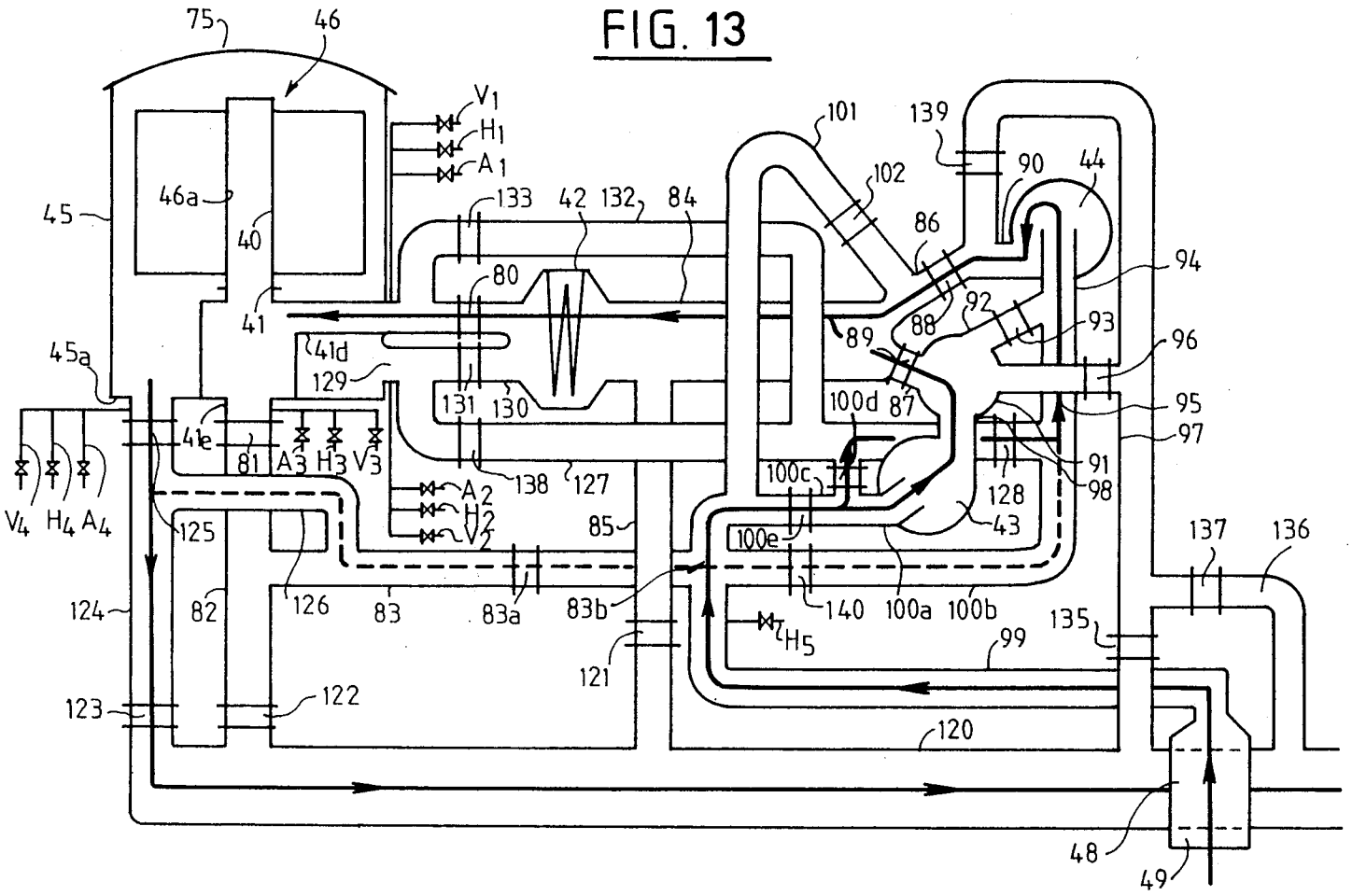

In this mode of operation, the two fluid flow means 43 and 44 are no longer operational in series but in parallel, FIG. 13.

At the outlet of the heat exchanger 48, the treatment air flows through duct 99, the inlet duct 100*a* of the air flow means 43 and simultaneously duct 100*c* leading to the intake pipe 94 of the flow means 44 so that the outlets from means 43 and 44 through branches 87 and 86, respectively, join up in the inlet duct 84 to the heat generator 42. The gaseous flow leaves said generator through duct 41*d*, penetrates into channel 40, passes through the windings to be treated from the inside towards the outside and leaves the tank 45 through valve 125 and duct 124, similarly to what was described above for example 5.

As in said example, a part of the gaseous fluid leaving tank 45 may be directed through duct 126, then duct 123, valve 140 and duct 100*b* for partial recycling.

EXAMPLE 8

Figure 14:
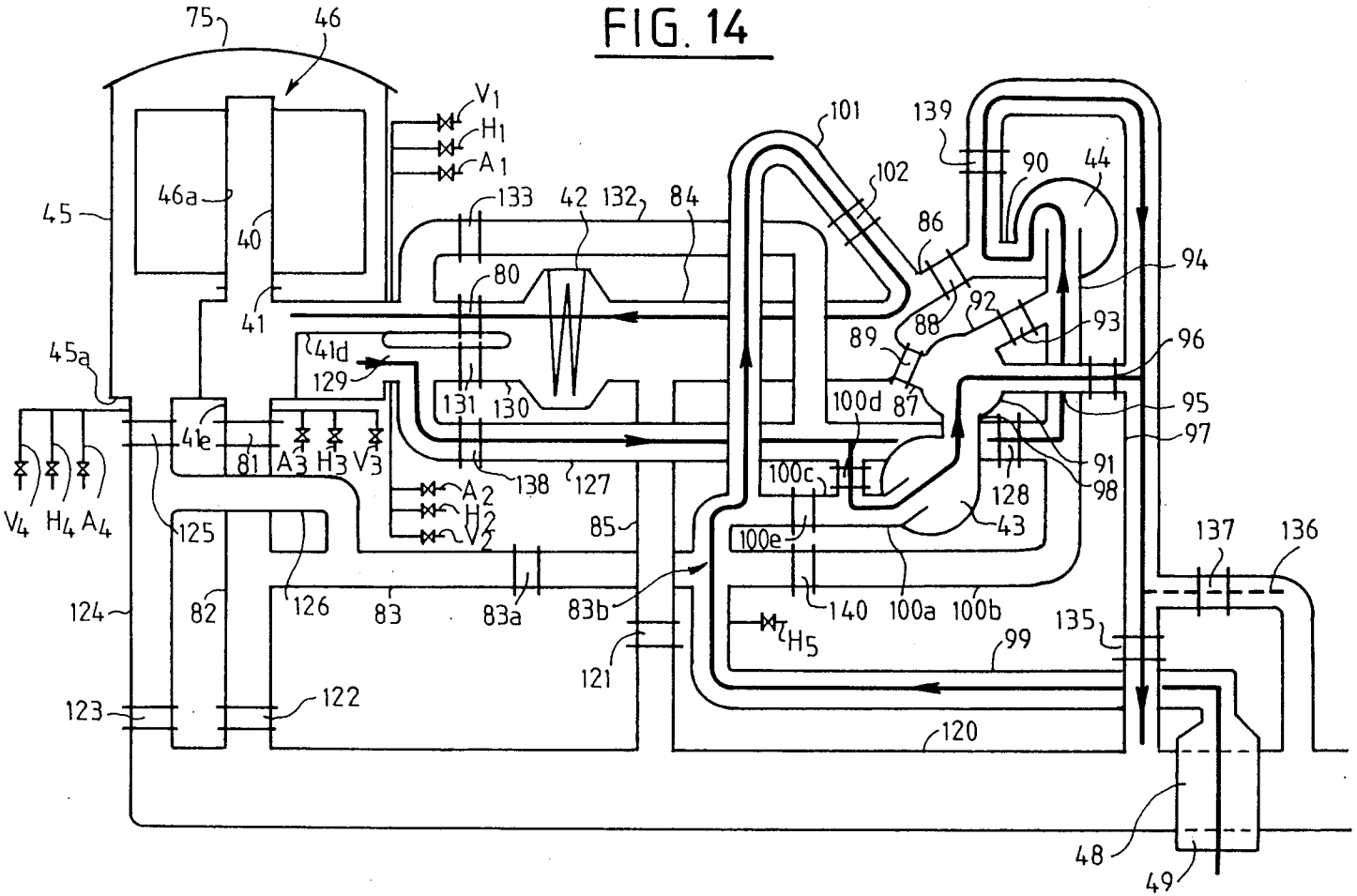

Whereas in the preceding example the flow means 43 and 44 are used for treatment under over pressure in the example now considered, FIG. 14, they are used for obtaining treatment by suction and in a parallel assembly as in the preceding example.

The path of the gaseous fluid then comprises, from the heat exchanger 48: duct 99, duct 101, the inlet duct 84 into the heat generator 42, the inlet duct 41*d* into channel 40, passing through the materials to be treated from the inside to the outside, then leaves the tank through orifice 129, duct 127, duct 100*c*, the inlet pipe 100*a* of the flow means 43 and simultaneously the intake pipe 94 of the flow means 44, the outlets from said flow means both discharging into duct 97 then into the outlet duct 120, FIG. 14.

As in example 6, a partial bypass of the outlet may be made through duct 136.

EXAMPLE 6

Figure 15:
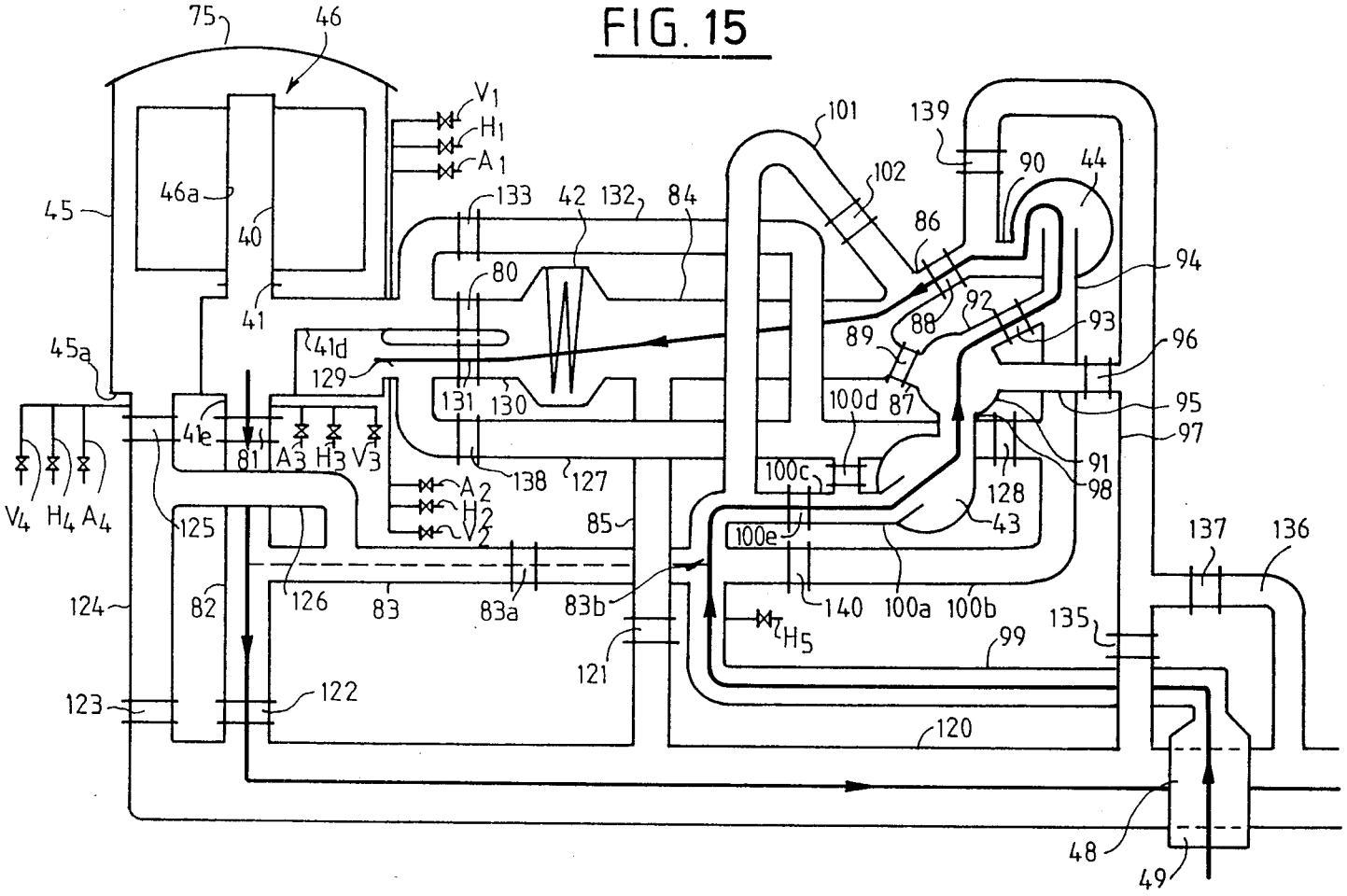

In this embodiment, FIG. 15, which uses the two flow means 43 and 44 in a series assembly, the path of the gaseous fluid from the heat exchanger 48 to the inlet of the heat generator 42 is identical with that of example 5.

In the present example however, the outlet from the heat generator 42 is not through duct 41*d* but through duct 130 so that the gaseous fluid penetrates inside tank 45 and passes through the windings to be treated from the outside towards the inside. The fluid is then discharged from channel 40 through valve 81, duct 82, valve 122 and duct 120.

As in example 5, partial recycling may be obtained by directing a certain amount of the fluid leaving the tank through duct 83, the path of the thus recycled fluid being shown with a broken line in FIG. 15.

EXAMPLE 10

Figure 16:
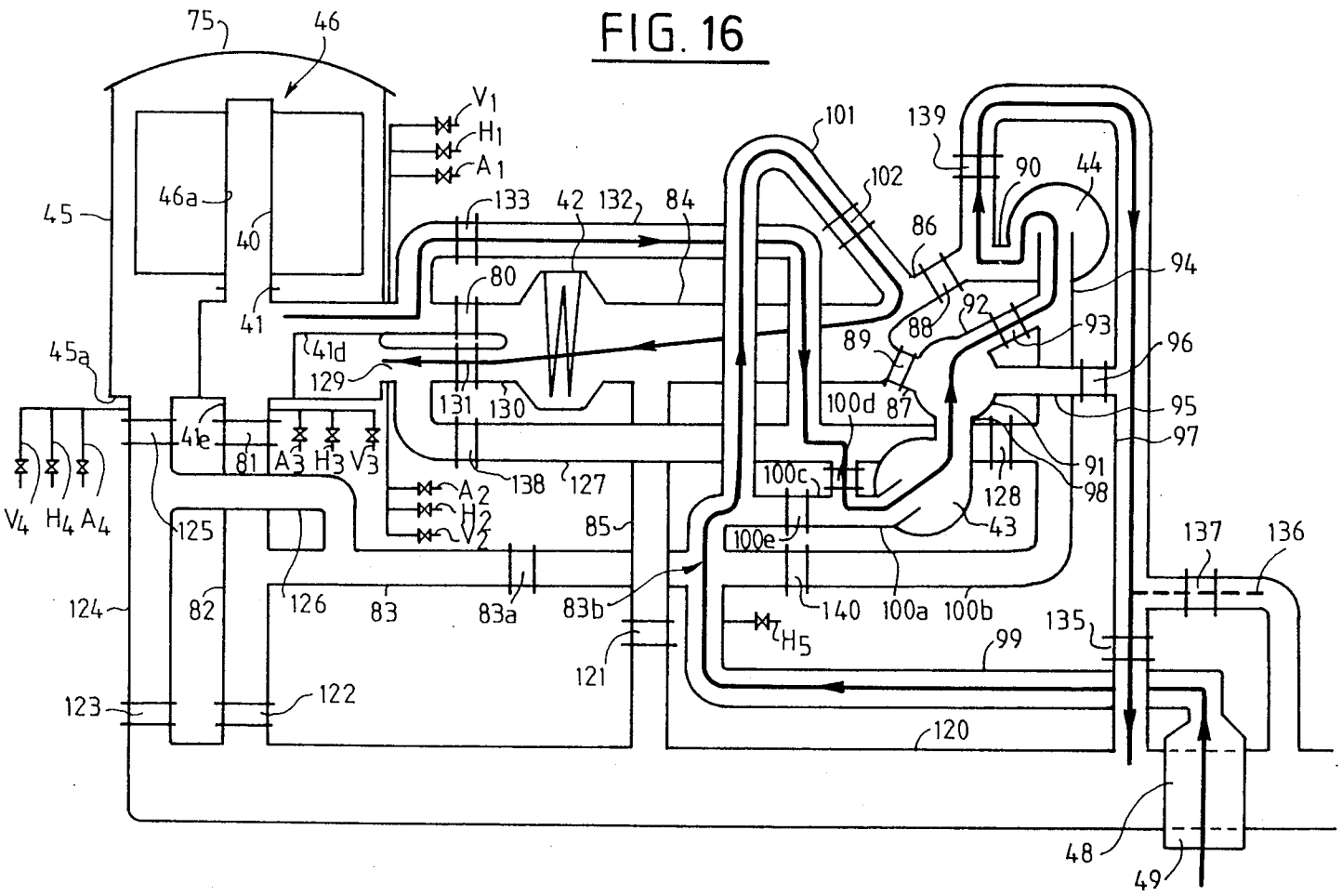

In this operating mode, FIG. 16, provided for causing the gaseous fluid to flow through the windings to be treated from the outside towards the inside, said fluid flow means 43 and 44 operate in series and exert a suction effect.

The path of the gaseous fluid is then as shown in FIG. 16, that is to say identical to that of example 6 between the heat exchanger 48 and the inlet into the heat generator 42, the outlet from said generator being however through duct 130 and not through duct 41*d* as in example 6.

After passing through the material to be treated the gaseous fluid leaves tank 45 through duct 132, flows through valve 100*d*, passes through the intake pipe 100*a* into the flow means 43, leaves this means through duct 98 and reaches the intake pipe 94 of the flow means 44, discharge from this flow means 44 being provided, because of closure of valve 88, through duct 90 leading to the outlet duct 120.

As in the examples 6 or 8, a bypass outlet through duct 136 may also be provided, the path of which is shown with a broken line in FIG. 16.

EXAMPLE 11

Figure 17:
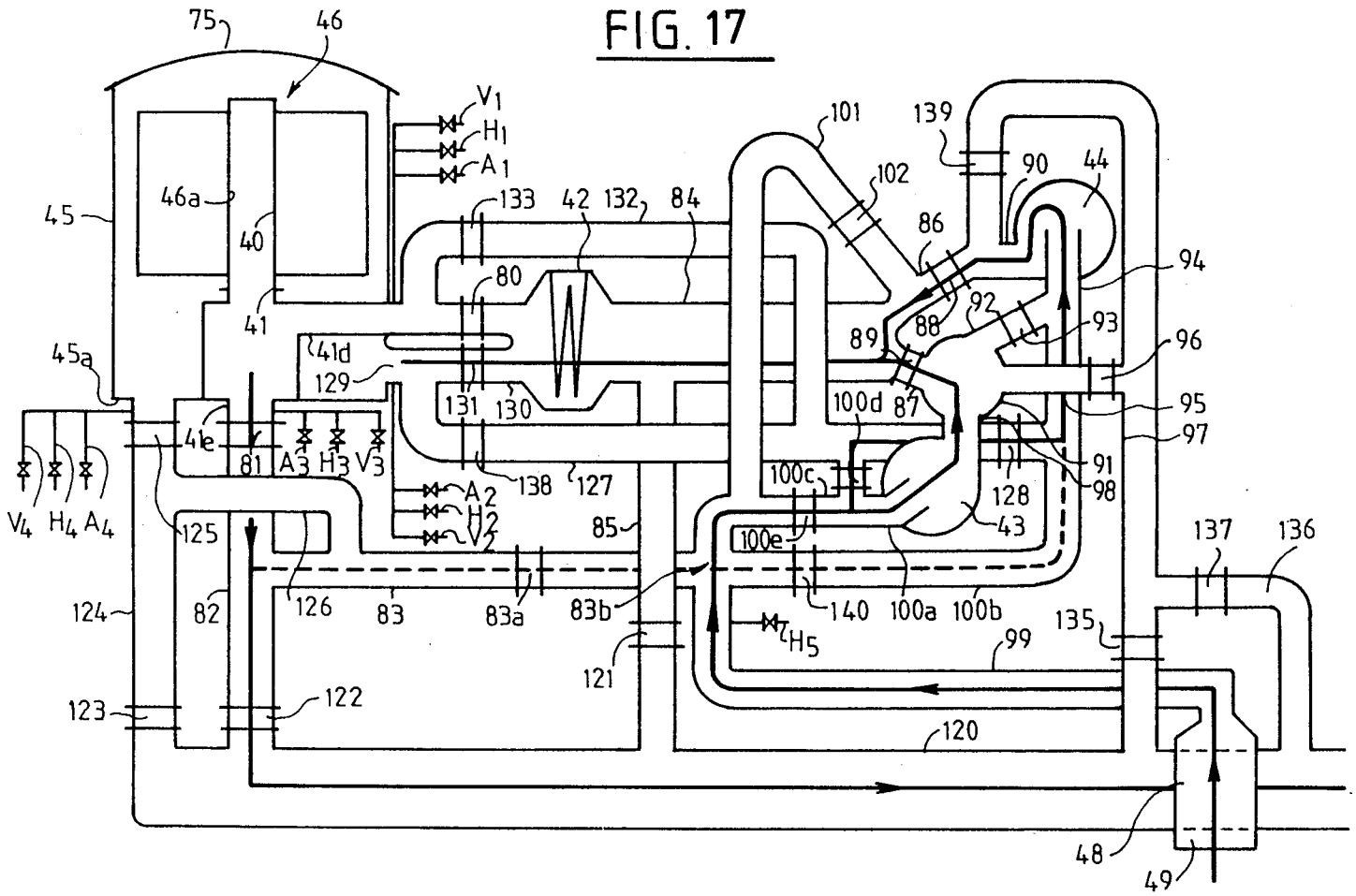

Flow of the treatment fluid is provided under over pressure from the outside towards the inside of the windings using a parallel assembly of the flow means 43 and 44, FIG. 17.

In this example, the path of the gaseous fluid from the heat exchanger 48 and as far as the inlet of the heat generator 42 is as in example 7.

Contrary to that example, however, the outlet from heat generator 42 is not through duct 41*d*, the gaseous fluid penetrating into the tank 45 through orifice 129 and leaving said tank through channel 40, through valve 81 and channel 82 to the outlet duct 120.

As in the operating mode of example 7, opening of valve 83*a* causes a certain amount of fluid to be taken from tank 45 and fed to the intake pipe 94 of the flow means 44, that is to say operation with partial recycling, FIG. 17.

EXAMPLE 12

Figure 18:
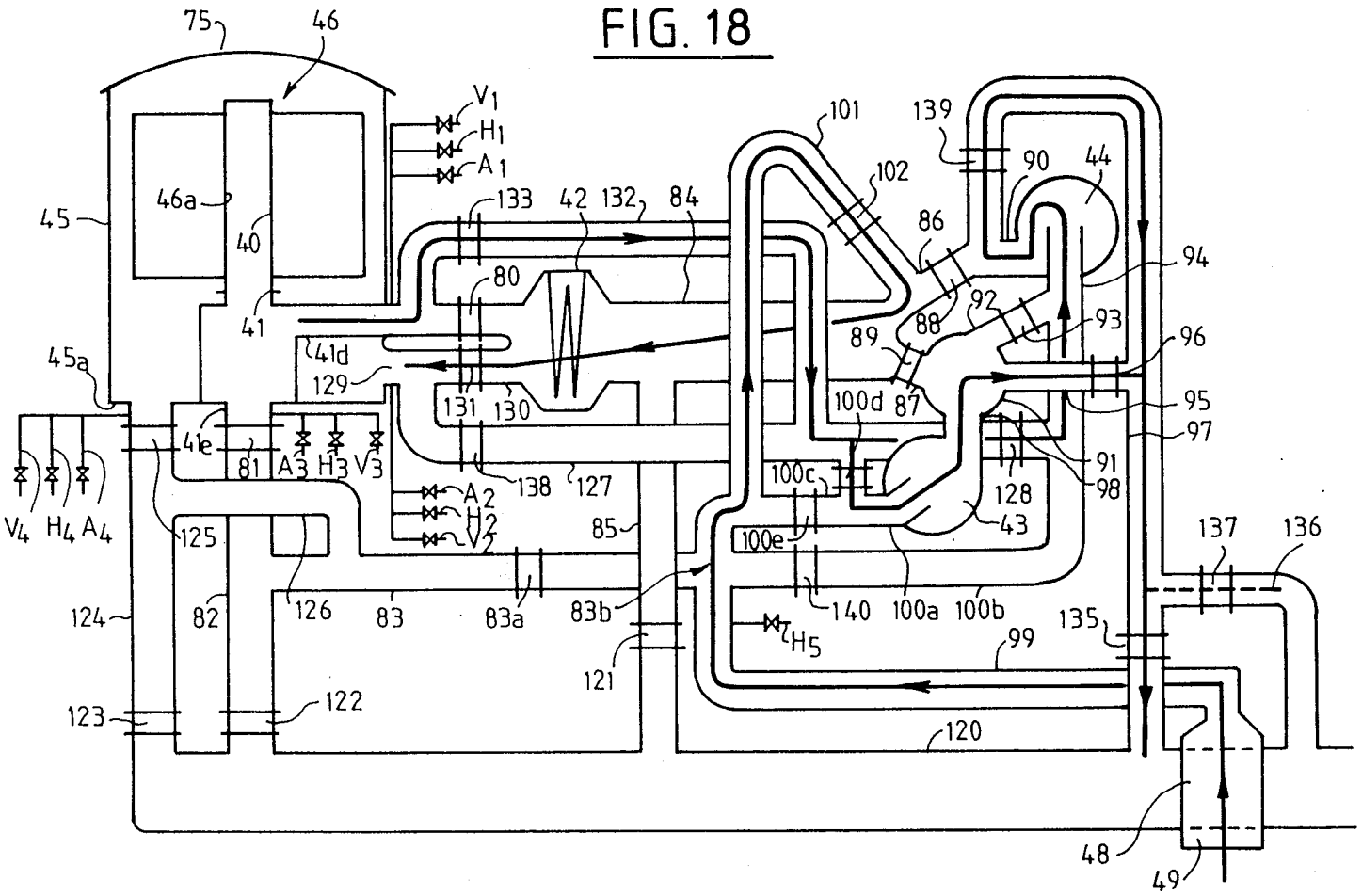

In this operating mode, illustrated in FIG. 18, the gaseous fluid is caused to pass through the windings of material to be treated, from the outside towards the inside, with suction, that is to say under reduced pressure through the material and with flow means acting in parallel.

From the heat exchanger 48 and as far as the inlet of the heat generator 42 the path of the fluid is identical to that of example 8 but, as opposed to that example, the outlet from the heat generator 42 is through valve 131, so that the gaseous fluid penetrates into tank 45 through orifice 129.

After passing through the material to be treated, the gaseous fluid leaves tank 45 through duct 41*d*, duct 132 and, from the junction of said duct with duct 127, follows the same path as that in example 11, that is to say a first stream is processed by the fluid flow means 43 whereas a second stream is processed by the fluid flow means 44, the outlet from said two means arriving in duct 97.

EXAMPLE 13

Figure 19:
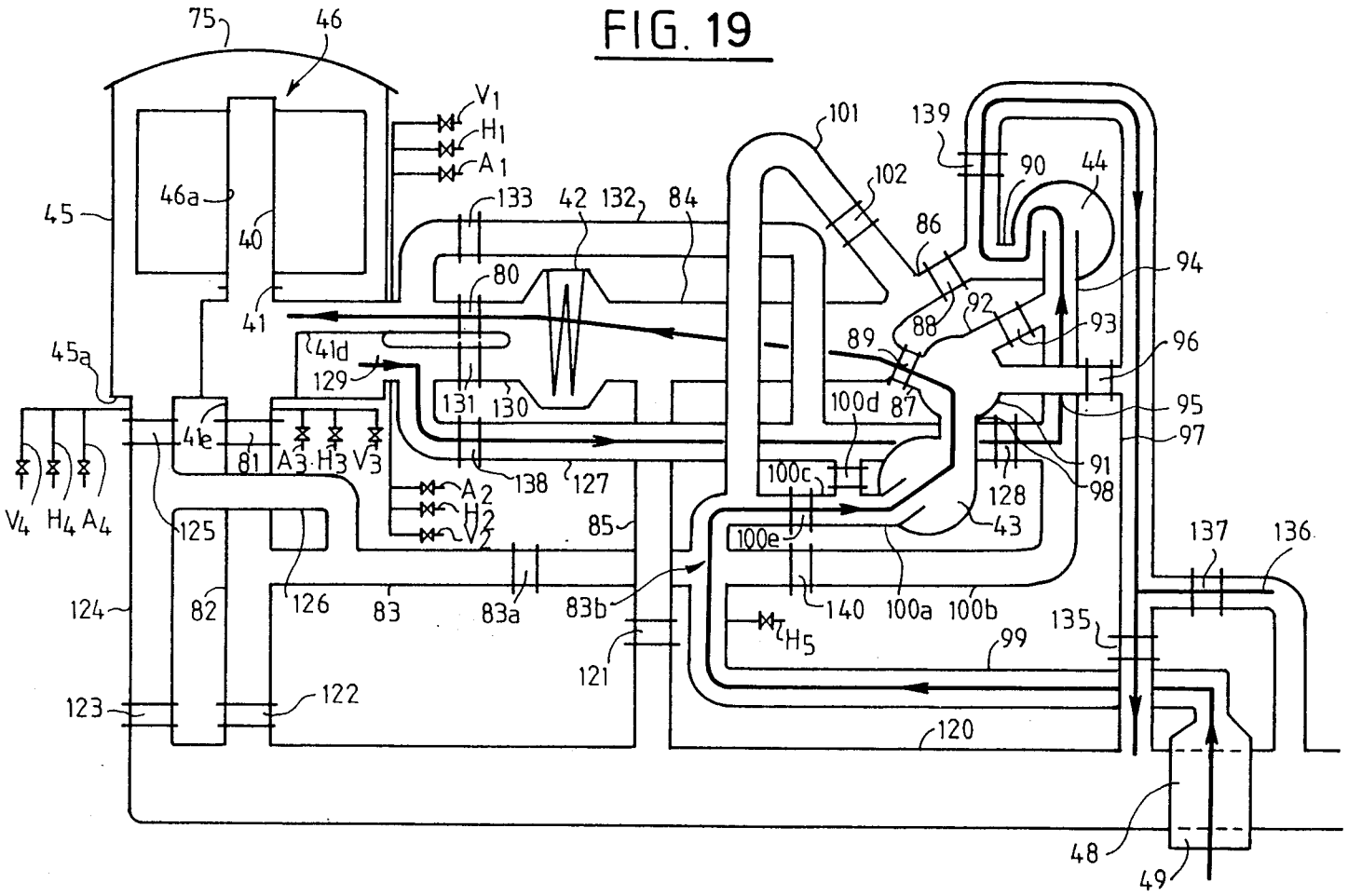

In this operating mode, the treatment is effected by causing the gaseous fluid to flow through the material to be treated from the inside towards the outside of the windings with, simultaneously, suction and over pressure, FIG. 19.

To this end, the gaseous fluid from the heat exchanger 48 is fed by duct 99 to the intake pipe 100*a* of the flow means 43. At the outlet of this latter, with valve 89 then open in the flow direction from distributor 91 to the heat generator 42, the gaseous fluid flows through said generator and penetrates into tank 45 through duct 41*d*. It then flows through channel 40, through the material to be treated and leaves the tank through orifice 129. Through duct 129 the gaseous fluid reaches the intake pipe 94 of the flow means 44 from which it leaves through duct 90 then duct 97, which is connected to duct 120 upstream and/or downstream of the heat exchanger 48.

EXAMPLE 14

Figure 20:
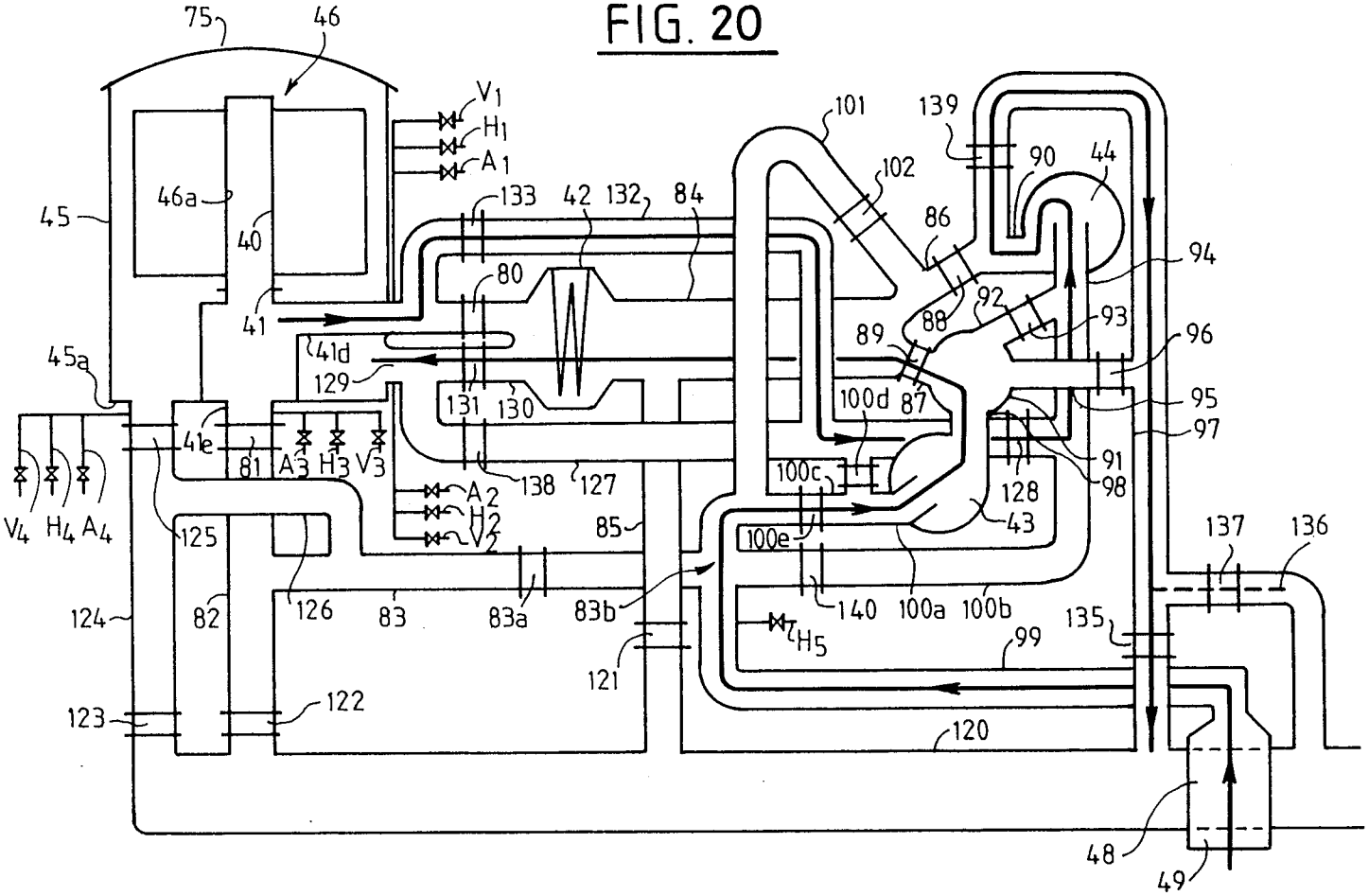

In this operating mode, FIG. 20, somewhat similar to the one described immediately above, the invention also provides for the simultaneous use of suction and over pressure.

However, contrary to the preceding example, the gaseous fluid is caused to flow so that it passes through the windings of material to be treated from the outside towards the inside, that is to say that the path of the fluid in this example is identical to the one of the preceding example for the part included between the heat exchanger 48 and the heat generator 42. However, instead of penetrating into the tank through duct 41*d*, the intake is through orifice 129, the outlet then being through duct 41*d*, duct 132, valve 128, the intake pipe 94 of the flow means 44 then the outlet from said means through valve 139 and duct 97.

As shown with full and broken lines in FIG. 20, the gaseous treatment fluid joins duct 120 upstream of the heat exchanger 48 and/or also downstream thereof, depending on the case.

EXAMPLE 15

Figure 21:
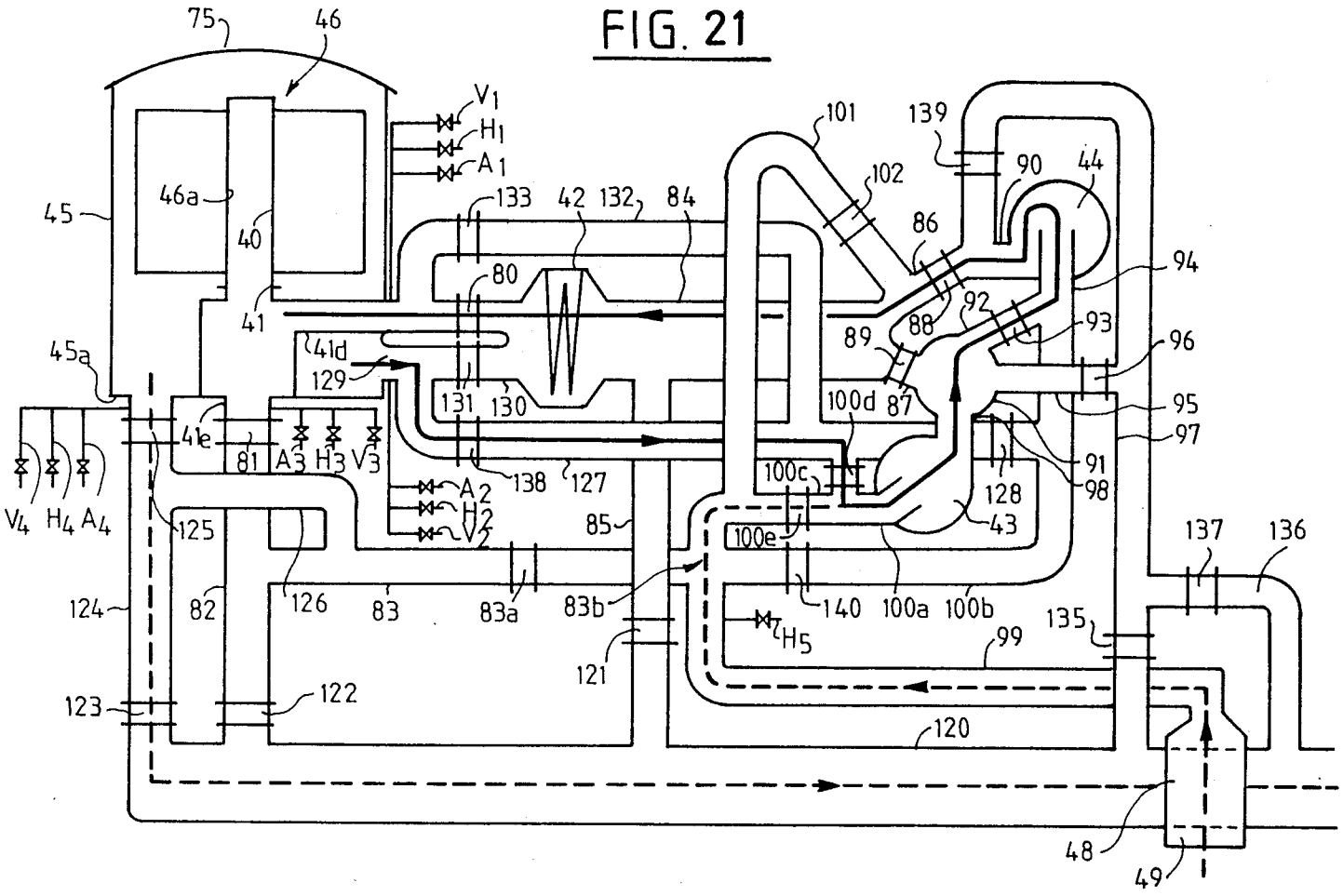

In this operating mode, FIG. 21, the gaseous fluid is caused to flow by the two means 43 and 44, for passing through the windings of material to be treated from the inside towards the outside.

In this operating mode, however, a first embodiment does not use an intake of air through the heat exchanger 48, so that the flow is in a closed circuit, that is to say with total recycling.

As shown by the continuous line arrows in FIG. 21, the air which penetrates into tank 45 through duct 41*d* and, from there, reaches channel 40, passes through the windings of material to be treated from the inside towards the outside and leaves tank 45 through orifice 129, duct 137, the intake pipe 100*a* of the flow means 43, distributor 91, valve 93, the intake pipe 94 of the flow means 44, the outlet from this means then being through valve 88, returning to the heat generator 42 from which it then leaves through duct 41*d*.

In a variant, and as shown with broken lines, valve 100*e*—upstream of the intake pipe 100*a* of the flow means 43—is open—whereas it was closed in the preceding conditions—so that a certain amount of air may be introduced into the circuit, the treatment then being with partial recycling.

EXAMPLE 16

Figure 22:
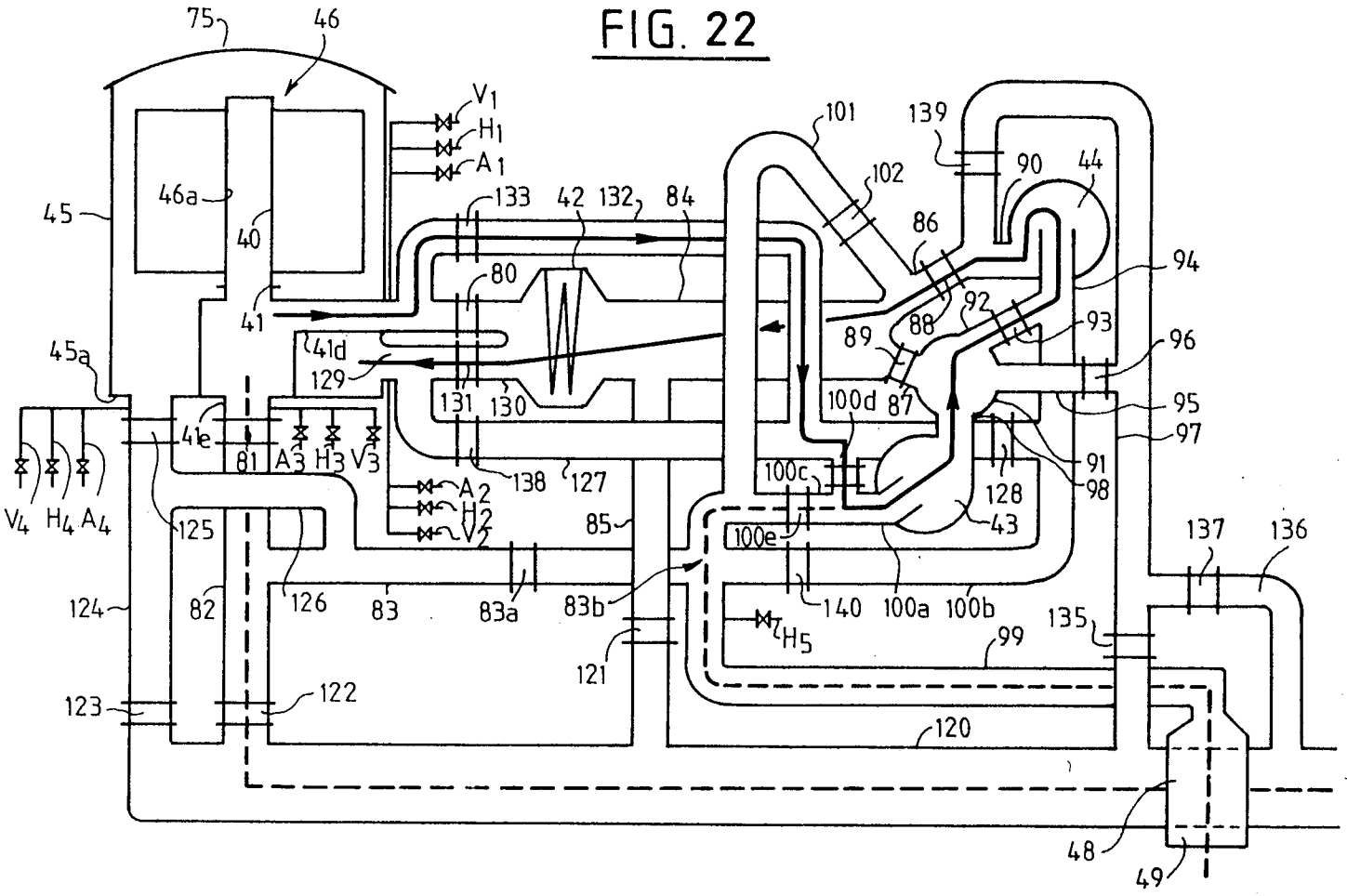

In this operating mode, closely related to that of the preceding example, the flow of gaseous fluid takes place from the outside to the inside through the windings of material to be treated, as shown by the continuous line arrows in FIG. 22.

The fluid then enters tank 45 through orifice 129, connected to the outlet of the heat generator 42 and the fluid leaves said tank through duct 41*d*, duct 132, valve 100*d*, the intake pipe 100*a* in the flow means 43, distributor 91, the intake pipe 94 in the flow means 44, valve 88 with return through duct 84 into the heat generator 42 from which the gaseous fluid again penetrates into the treatment tank.

As in the preceding example, instead of the above described operating mode which is with total recycling, another mode of operation may be used, when valve 100*e* is momentarily open. Similarly, to the embodiment of example 15, where a partial fluid outlet may be provided through valve 125 and duct 124 in example 16 an outlet is provided through valve 81 and duct 82.

EXAMPLE 17

Figure 23:
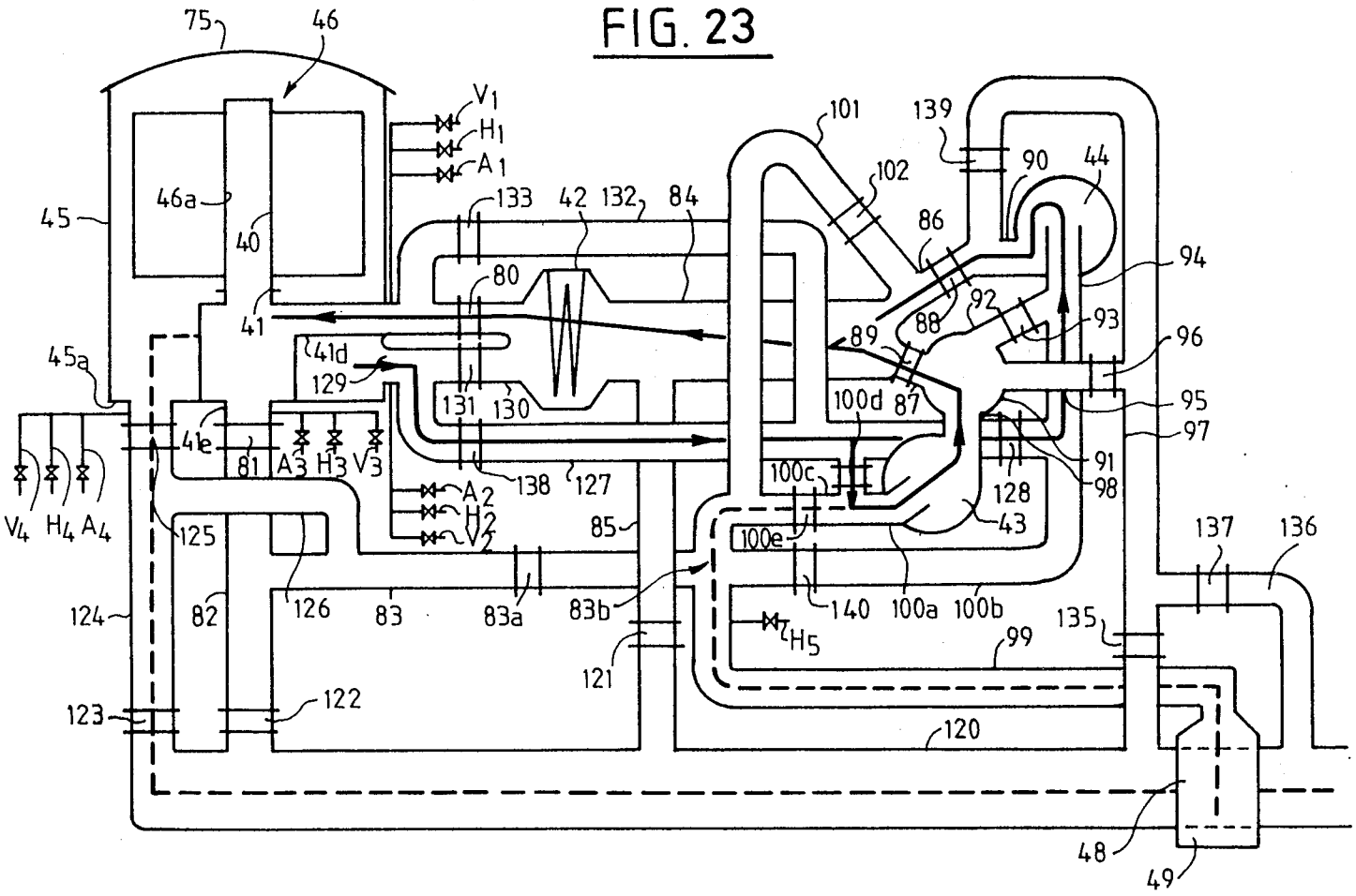

In this operating mode, the gaseous fluid flow means 44 are mounted in parallel, FIG. 23.

In a first condition valve 100*e* is closed, the gaseous treatment fluid penetrates into tank 45 through duct 41*d*, channel 40, passes through the windings of material to be treated from the inside towards the outside, leaves tank 45 through orifice 129 and is brought by duct 127, on the one hand, to the intake pipe 100*a* of the flow means 43 and, on the other hand to the intake pipe 94 of the flow means 44. The outlets from means 43 and 44, through branches 87 and 86, respectively, join up in duct 84 leading to the heat generator 42 the outlet from which through duct 41*d* reintroduces the gaseous fluid, with total recycling, into the tank 45.

In a variant, illustrated with broken lines, the recycling is only partial; with valve 100*e*, a certain amount of air is admitted from the heat exchanger 48, whereas with valve 125 also open a certain amount of air may be removed from tank 45 through duct 124 and valve 123 as far as duct 120.

EXAMPLE 18

In this operating mode, similar to the one described immediately above, the flow of gaseous fluid is from the outside towards the inside of the windings of material to be treated.

The introduction of gaseous fluid into tank 45 takes place consequently through orifice 129, at the outlet of the heat generator 42, whereas the outlet from said tank is through duct 41*d*, duct 132, the intake pipe 100*a* of the flow means 43 and simultaneously the intake pipe 94 of the flow means 44, the outlets from said two means being brought together through branches 87 and 86, respectively, to reach duct 84 and the heat generator 42, from which the fluid leaves through orifice 129 as indicated above.

Figure 24:
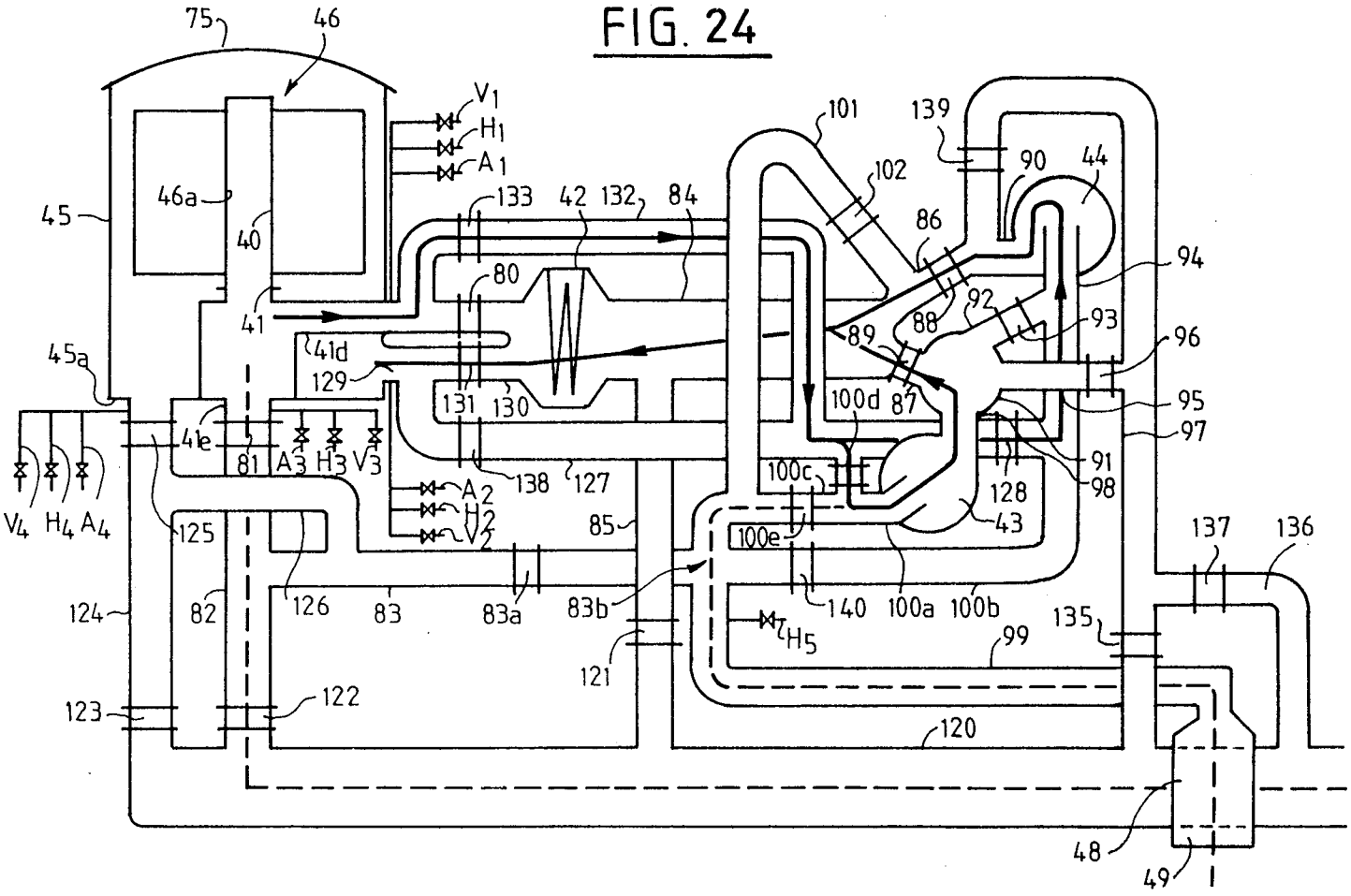

In this embodiment, also, partial recycling may be obtained when, on the one hand, valve 100*e* is open and when, on the other hand, a part of the gaseous fluid is discharged through valve 81 into duct 82 and into duct 120, FIG. 24.

The installation of the invention may treat fibrous, porous or filament materials in a multiplicity of operating modes whether said materials are in the form of hanks, wound thread, roves, combed tops, woven or knitted tops, knitted or woven wear.

Thus, for removing water from the volumes of material to be treated, whether they are in the form of windings or packages, a pressurized water vapor flow is provided, being introduced into the installation by actuating devices $V_1$–$V_4$, either through the inlet of tank 45 into duct 41*d* or into duct 130, in the vicinity of orifice 129, or else into ducts 82 or 124. The flow of the vapor through the material may take place either under the effect of the vapor pressure itself, or by using the under pressure or the over pressure of the flow means 43 and/or 44 with or without air intake.

After removal of water, when the windings or packages of material to be treated are still heavily impregnated with water, and so not very permeable to the flow of gaseous fluid, particularly at the beginning of the drying treatment, operation is as shown in examples 5 or 9, that is to say by operating the two flow means in series for an over pressure operation.

As soon as the permeability of the material to be treated is sufficient, the installation is caused to operate as described with reference to example 7 (FIG. 13) or to example 8 (FIG. 14), that is to say also with the two fluid flow means, but this time with parallel assembly.

On the other hand, for materials likely to undergo deformations such as felting or tangling or during a high rate gaseous fluid flow rate, the invention provides, from a certain humidity rate, for the use not of the two flow means but of a single one, for example as described in examples 1 to 4, and with reference to FIGS. 7 to 10.

Both in the case of using one or two gaseous fluid flow means, the invention provides advantageously a suction operating mode, examples 2, 4, 6 and 10, by placing under reduced pressure a part of the material to be treated, that is to say with lowering of the vapor tension and or the temperature of said material.

Drying, carried out at this lower temperature, preserves the intrinsic qualities of certain textile materials, such as shrinkage, feel, fullness, etc . . .

Furthermore, the fact of treating at a lower temperature than that generally used reduces entirely or partly the risks of migration of the dyes or of the finishing products deposited on the material, such migration taking place from the damper parts towards the drier parts and being promoted by the high temperatures of the drying air.

The risks of yellowing are also reduced in this way, in the case of fibrous textile materials, which yellowing is promoted by the high temperatures of the drying air, in particular for bleached materials or materials tinted with light colors.

The presence of devices A and H considerably increases the possibilities of use of the installation of the invention for conditioning fibrous materials, particularly textile materials.

In fact, by means of devices A, one or more finishing products may be introduced into the fluid flow ducts for depositing on the treated material so as to confer thereon the desired quality. The finishing product may, for example, be a softener or lubricant for improving the feel or for facilitating subsequent use of the material during weaving, knitting or during use, for example for sewing thread.

Devices H, by means of which the invention introduces pressurized water and/or with spraying into the gaseous treatment fluid, contribute to obtaining satisfactory and rapid conditions and/or reconditioning.

It is in effect known that for textile materials, in particular, there exist relative humidity rates considered as optimum and which vary from one fiber to another. Thus, for cotton, such a rate is of the order of 7 to 8%, whereas it is of the order of 16% for wool. Now, at the end of the drying operations, it frequently happens that this relative humidity rate is less than the optimum value, for example of the order of 1 to 2% at the end of treatment of cotton fibers.

Whereas the usual conditioning techniques consist in exposing the treated material to the ambient air for progressively returning it to its natural balanced state, this procedure is both relatively long and non uniform. For example, non-uniformity between the inside and outside the volumes of treated material causes defects of homogeneity and delays in use detrimental in modern high productivity factories.

This is why, according to the invention, fresh ambient air is caused to flow through the treated material with or without addition of pressurized water, by spraying, introduced through devices H, or with any other means for humidifying the air introduced by devices H, with or without recycling, so as to bring the relative humidity rate of the treated material to a value close to the optimum conditioning rate, this flow being carried out with the heat exchanger 48 made momentarily inoperative and following the operating modes of examples 15 to 18, FIGS. 21 to 24, without this indication having any limiting character whatsoever.

In the foregoing, the method and installation have been described for a vertical treatment tank in which the material carrier is also vertical.

It goes without saying that the invention also applies, except for the treatment of hanks, to a method or installation in which the treatment tank is horizontal, the material carrier being disposed correspondingly.

Obviously, numerous additional modifications and variations of the present invention are possible in light of the above teachings. It is therefore to be understood that within the scope of the appended claims, the invention may be practiced otherwise than as specifically described herein.

What is claimed is:

1. A method of using a single enclosure to treat fibrous, porous or filament materials contained therein with a flow of gaseous fluid, said method comprising the steps of:

providing a single enclosure adapted to contain material to be treated;

introducing material to be treated into the enclosure;

making a first determination of whether it is desired to treat the materials during a drying phase under a reduced pressure condition of the flowing gaseous fluid or under an over pressure condition of the gaseous fluid;

making a second determination of whether it is desired to cause the gaseous fluid to flow through the material in a direction from an inside portion of the material toward an outside portion of the material or in a direction from an outside portion of the material toward an inside portion of the material or in a vertical direction through the material;

making a third determination of whether or not is is desired for the gaseous fluid to be in a heated thermal condition or in a non-heated thermal condition during said drying phase;

making a fourth determination of a desired humidity condition of the gaseous fluid during said drying phase by determining whether or not it is desired to introduce humidity into the gaseous fluid during said drying phase;

making a fifth determination of a desired composition of the gaseous fluid by determining whether or not it is desired to introduce a finishing product into the gaseous fluid for deposition on the material in the enclosure;

conducting said drying phase by causing a stream of gaseous fluid to flow through the material in the enclosure and, during said flow, establishing a pressure condition of the flow in accordance with said first determination, establishing a flow direction through the material in the enclosure in accordance with said second determination, establishing a thermal condition of the flow in accordance with said third determination, establishing a humidity condition of the flow in accordance with said fourth determination, and establishing a composition of the gaseous flow in accordance with said fifth determination;

making a sixth determination of whether or not it is desired to follow the drying phase with a reconditioning phase;

if said sixth determination is positive, making a seventh determination of whether it is desired to conduct said reconditioning phase under a reduced pressure condition or under an over pressure condition;

if said sixth determination is positive, making an eighth determination of a desired humidity condition by determining whether or not it is desired to introduce humidity during said reconditioning phase;

if said sixth determination is positive, causing a stream of fresh ambient air to flow through the material in the enclosure and, during said flow, establishing said pressure condition and said humidity condition in accordance with said seventh and eighth determinations, respectively.

2. A method as claimed in claim 1, wherein at least one of said steps of causing a gaseous fluid to flow through the material to be treated comprises the steps of using a plurality of flow means to cause said flow and of moving said fluid through said flow means in series.

3. A method as claimed in claim 1, wherein at least one of said steps of causing a gaseous fluid to flow through the material to be treated comprises the steps of using a plurality of flow means to cause said flow and of moving said fluid through said flow means in parallel.

4. A method as claimed in claim 1, wherein at least one of said steps of causing a gaseous fluid to flow through the material to be treated comprises the steps of using at least one flow means to deliver the gaseous fluid to the enclosure under an over pressure and using at least one additional flow means to remove the gaseous fluid from the enclosure under reduced pressure.

5. A method as claimed in claim 1, further comprising the step of introducing compressed air into the flow of gaseous fluid.

6. A method as claimed in claim 1, wherein said step of introducing material to be treated into the enclosure comprises the step of providing in the enclosure a plurality of suspended hanks of material to be treated.

7. A method as claimed in claim 6, wherein said step of making a second determination comprises the step of determining that it is desired for the gaseous fluid to flow in a vertical direction through the suspended hanks.

8. An installation for drying or conditioning fibrous, porous or filament materials comprising:

a single enclosure adapted to contain material to be treated and having means creating a fluid flow path therethrough, a portion of said fluid flow path of said enclosure extending between an interior portion of the material to be treated and an exterior portion of the material to be treated;

ductwork and a plurality of fluid valving means therein for handling a gaseous fluid, said ductwork being in communication with said flow path of said enclosure;

flow means connected to said ductwork for causing the gaseous fluid to move therethrough;

heating means connected to said ductwork and being selectively operable to heat the gaseous fluid flowing therethrough, said ductwork, valves and flow means comprising means for selectively:

moving the gaseous fluid through said heating means and for forcing the gaseous fluid under an over pressure in a first direction through said flow path of said enclosure, moving the gaseous fluid through said heating means and for forcing the gaseous fluid under an over pressure in a second direction through said flow path of said enclosure, moving the gaseous fluid through said heating means and for moving the gaseous fluid under reduced pressure in said first direction through said fluid flow path of said enclosure, and moving the gaseous fluid through said heating means and for moving the gaseous fluid under reduced pressure in said second direction through said fluid flow path of said enclosure, wherein said installation further comprises means for selectively introducing water vapor into said ductwork, means for selectively spraying water into said ductwork, means for selectively spraying a material finishing product into said ductwork, and means for selectively introducing compressed air into the gaseous fluid.

9. An installation as claimed in claim 8, wherein said flow means comprise a plurality of flow means.

10. An installation as claimed in claim 9, comprising means for connecting said plural flow means in series for said moving of the gaseous fluid under reduced pressure through said fluid flow path of said enclosure.

11. An installation as claimed in claim 9, comprising means for connecting said plural flow means in parallel for said moving of the gaseous fluid under reduced pressure through said fluid flow path of said enclosure.

12. An installation as claimed in claim 9, comprising means for connecting said plural flow means for passing the gaseous fluid through said enclosure under reduced pressure and so that at least one of said flow means passes the fluid to said enclosure and at least one of said flow means removes the gaseous fluid from the enclosure.

13. An installation as claimed in claim 9, comprising means for connecting said plural flow means in parallel for said moving of the gaseous fluid under an over pressure through said fluid flow path of said enclosure.

14. An installation as claimed in claim 9, comprising means for connecting said plural flow means in series for said moving of the gaseous fluid under an over pressure through said fluid flow path of said enclosure.

15. An installation as claimed on claim 8, comprising means for recirculating the gaseous fluid in a closed path through said flow means, heating means and enclosure, and means for selectively withdrawing some of said gaseous fluid from said closed path.

16. An installation as claimed in claim 8, wherein said flow means comprise a plurality of flow means, further comprising means for selectively connecting said plural flow means in series or in parallel.

17. An installation as claimed in claim 8, further comprising distribution means disposed in said single enclosure for distributing the gaseous fluid through the material to be treated.

18. An installation as claimed in claim 8, further comprising centering means disposed in said enclosure for cooperating with a carrying device for the material to be treated to center the carrying device in said enclosure, said centering means being removably received in said enclosure.

19. An installation as claimed in claim 18, wherein said centering means comprise a plurality of rods, each rod being bent to form an upper leg and a lower leg, said rods having upper legs of different lengths, further comprising means fixed inside said enclosure for removably receiving said upper legs of a plurality of said bent rods and a circular sector fixed inside said enclosure and spaced from said ring for removably receiving said lower legs of said bent rods, there being a plurality of holes formed in said circular sector and disposed in a plurality of concentric circles, said lower legs being received in said holes.

20. An installation as claimed in claim 8, further comprising a material holder having means for suspending a plurality of hanks, said flow path of said enclosure including a portion providing vertical flow through said suspending means.

21. An installation as claimed in claim 8, further comprising a material carrier for the material to be treated and means for clamping, centering and locking said material carrier inside said enclosure.

22. An installation as claimed in claim 21, further comprising fluid distributing means in said enclosure for distributing the gaseous fluid to said material carrier and sealing means for forming a fluid seal between said distributing means and said material carrier, said fluid distributing means and said sealing means being configured for sealingly mating said distributing means with a plurality of material carriers of differing configurations.

* * * * *